US007546058B2

(12) United States Patent
Katoh et al.

(10) Patent No.: US 7,546,058 B2
(45) Date of Patent: Jun. 9, 2009

(54) IMAGE FORMING APPARATUS WITH PARTITIONING MEMBER

(75) Inventors: Atsuyuki Katoh, Tenri (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 287 days.

(21) Appl. No.: 11/457,480

(22) Filed: Jul. 14, 2006

(65) Prior Publication Data

US 2007/0031163 A1 Feb. 8, 2007

(30) Foreign Application Priority Data

Aug. 4, 2005 (JP) ..... 2005-227096

(51) Int. Cl.
*G03G 21/20* (2006.01)

(52) U.S. Cl. ..... 399/92; 399/98

(58) Field of Classification Search ..... 399/92, 399/93, 98, 99, 107
See application file for complete search history.

(56) References Cited

U.S. PATENT DOCUMENTS 4,154,521 A * 5/1979 Tanaka ..... 399/93
4,178,092 A * 12/1979 Yamamoto et al. ..... 399/93
5,073,796 A * 12/1991 Suzuki et al. ..... 399/93
5,946,528 A * 8/1999 Cho ..... 399/93
6,151,466 A * 11/2000 Fujiwara ..... 399/92
2005/0129424 A1 * 6/2005 Park ..... 399/93

FOREIGN PATENT DOCUMENTS

| | | |
|---|---|---|
| JP | 10-003220 | 1/1998 |
| JP | 11-038728 | 2/1999 |
| JP | 2003-241484 | 8/2003 |
| JP | 2004-272122 | 9/2004 |

OTHER PUBLICATIONS

Sigma Hi-Chemical Inc.; "Magnetic Fluid"; 2006 (http://www.sigma-hc.co.jp/english/magnetic_fluid.html).

* cited by examiner

*Primary Examiner*—David M Gray
*Assistant Examiner*—Laura K Roth
(74) *Attorney, Agent, or Firm*—Renner, Otto, Boisselle & Sklar, LLP

(57) ABSTRACT

A partition is provided to isolate a space from outside thereof, the space encompassing a space where an image holding member, a developing device, a charging device, a transfer device, and a fixing device. The isolated space is under reduced pressure. This allows the image forming apparatus to avoid negative effect caused by humidity change.

25 Claims, 10 Drawing Sheets

IMAGE FORMING APPARATUS WITH PARTITIONING MEMBER

This Nonprovisional application claims priority under 35 U.S.C. § 119(a) on Patent Application No. 227096/2005 filed in Japan on Aug. 4, 2005, the entire contents of which are hereby incorporated by reference.

FIELD OF THE INVENTION

The present invention relates to an image forming apparatus which allows an electrostatic latent image, formed on an image holding member, to be visualized with developer.

BACKGROUND OF THE INVENTION

Conventionally, an electrophotographic image forming apparatus has been widely used as an image forming apparatus such as a copying machine, a printer, or a facsimile machine.

In the electrophotographic image forming apparatus, the following processes are made. Specifically, a photoreceptor surface of an image holding member such as a photoreceptor drum is charged by a charging device, and the photoreceptor surface thus charged is exposed to light by an exposure device. As a result, an electrostatic latent image is formed on the photoreceptor surface. Then, the electrostatic latent image thus formed is developed by a developing device, thereby forming a toner image (visible image) on the photoreceptor surface. Thereafter, the toner image is transferred onto a sheet (recording medium, such as plain paper or OHP recording paper) by a transfer device and then fixed to the sheet by a fixing device.

Meanwhile, in recent years, toner has been downsized to improve image quality or increase a printing speed. This results in frequent scattering and floating of such toner, in the image forming apparatus. Especially, floating toner contained in the air exhausted from the image forming apparatus has become a problem.

In view of the circumstances, Japanese Unexamined Patent Publication No. 272122/2004 (published on Sep. 30, 2004) teaches a technique in which a vacuum generator for sucking air via an air filter is provided to a developing device. The vacuum generator sucks floating toner existing in the vicinity of an aperture of the developing device.

Further, Japanese Unexamined Patent Publication No. 003220/1998 (Tokukaihei 10-003220, published on Jan. 6, 1998) teaches a technique to provide airflow generating means for generating an airflow, from the outside to the inside of the development apparatus, in a gap between (i) a latent-image holding member and (ii) carrier collecting means, a part of which is exposed through an opening of a casing of a development unit.

Further, the electrophotographic image forming apparatus has another problem. Specifically, ozone or nitrogen oxide is generated in the charging device and contaminates the environment around the image forming apparatus. Furthermore, it is known that if nitrogen oxide adheres to a photoreceptor drum, an image defect called whiteout occurs.

In order to prevent generation of ozone or nitrogen oxide in a charging device, Japanese Unexamined Patent Publication No. 38728/1999 (Tokukaihei 11-38728, published on Feb. 12, 1999) teaches a technique to close the space between a charging member and a member to be charged in an image forming apparatus adopting a charging device of contact electrification. By reducing the pressure of the closed space, charging efficiency can be improved.

Further, Japanese Unexamined Patent Publication No. 241484/2003, teaches a charging device including (i) a corona-charger with a conductive shield and (ii) a duct provided surrounding the corona-charger, wherein, during rotation of an image holding member, A>B>C, where A is an air-pressure in the shield, B is an air-pressure in the duct, and C is an air-pressure outside of the duct. This prevents a discharge product, such as ozone, NOx, and the like, from adhering to the image holding member.

The above techniques, however, have a problem that if humidity within the image forming apparatus changes, image quality is degraded and -processing becomes less efficient.

For example, with the technique of Japanese Unexamined Patent Publication No. 2004-272122, it is possible to reduce the amount of scattered toner, but the humidity in the space between the photoreceptor and the developing device becomes substantially the same as the circumambient humidity. Therefore, the increase in the circumambient humidity causes a reduction in a resistance of toner (developer), so that the amount of charges decreases. This degrades the performance of development.

Further, since the technique of Japanese Unexamined Patent Publication No. 38728/1999 (Tokukaihei 11-38728) is applicable to a charging device of contact electrification, the technique is not applicable to a charging device of non-contact electrification such as corona charging. In a charging device of corona charging, if the humidity increases in the space between the charging member (discharge electrode) and the photoreceptor, a discharge onset voltage also increases. This reduces charging efficiency. Therefore, according to the technique of Japanese Unexamined Patent Publication No. 38728/1999 (Tokukaihei 11-38728), it is not possible to prevent a reduction in charging efficiency due to a change in humidity, in the charging device of non-contact electrification. It is well known from Paschen's law that a discharge onset voltage is in proportion to a product of gas pressure and an interval between charging electrodes.

Further, in the transfer device, resistances of respective sections change in response to a change in humidity of, for example, a transfer member, a sheet transporting path (sheet path), a sheet, and/or toner, and therefore transfer efficiency decreases.

Further, in the fixing device, humidity change causes a change in each heat conductivity of, for example, members of the fixing device, a sheet, or toner to change. This causes heat energy to be used less efficiently, and therefore fixing efficiency decreases.

SUMMARY OF THE INVENTION

The present invention is in view of the above problems, and has as an object to prevent humidity change from causing processing efficiency of an image forming apparatus to decrease.

An image forming apparatus according to the present invention is an image forming apparatus including (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image (e) a transfer device for transferring the visualized image onto a recording medium, and (f) a fixing device for fixing, to the recording medium, the developer transferred to the recording medium. In order to attain the object, the image forming apparatus according to the present invention further includes: a partitioning member for isolating a space from an outside space, the space encompassing at least: (i) a space encompassing (a) the developing device and (b) a part of the image holding member, which part faces the developing device; (ii) a space encompassing (a) the transfer device and (b) a part of the image holding member, which part faces the transfer device; and (iii) a space encompassing the fixing device; and a pressure reducing device for reducing a pressure of an isolated space below a pressure of the outside space.

In the above structure, the pressure of the isolated space is reduced so that a decrease in processing efficiency due to humidity change can be prevented.

For example, with the arrangement the space including (a) the developing device and (b) a part of the image holding member, which part faces the developing device is partitioned off (isolated) from the outside and is under reduced pressure, the humidities in (a) the developing device and (b) the space between the image holding member and the developing device are prevented from increasing. This prevents the toner from absorbing the moisture, and therefore prevents a resistance of the toner from decreasing, thereby preventing a decrease in an amount of an electric charge the toner bears. Thus, the deterioration in the performance of development due to humidity change can be prevented.

Further, by reducing the pressure of the space, an air resistance can be reduced. This shortens a flight duration of the toner, and therefore airborne toner can be collected efficiently. Thus, even in the case where, for example, toner is downsized in order to improve image quality, the toner can be collected efficiently. Further, the airflow due to, for example, rotation of the image holding member or the rotating members (e.g., development roller, stirrer roller) of the developing device is restrained, and therefore scattering of the toner is also restrained. Thus, even in the case where, for example, rotation of the image holding member is speeded up in order to expedite the processing speed (to increase the number of sheets can be handled by the image formation per unit time), the airflow due to the rotation can be restrained, and therefore scattering of the toner can also be restrained. Further, by reducing the pressure inside of the partitioning member, the toner can be prevented from spouting out of the partitioning member.

Further, with this arrangement the space including (a) the transfer device and (b) a part of the image holding member, which part faces the transfer device is partitioned off from the outside and is under reduced pressure space, a resistance change due to humidity change is reduced, which humidity change occurs in, for example, the transfer device, the paper path (recording paper transporting path), the recording medium, or toner. This restrains a decrease in transfer efficiency.

Further, with the arrangement in which the space including the fixing device is partitioned off from the outside is under reduced pressure space, heat-conductivity change caused by humidity change is reduced, which humidity change occurs in the members of the fixing device, a recording medium, or toner. As a result, a decrease in fixing performance due to heat-conductivity change and in efficiency in utilizing heat energy is restrained. Further, by reducing the pressure of the space including the fixing device, air convection in the vicinity of the fixing device is reduced. This restrains heat dispersion caused by the air convection, and therefore loss of heat energy is reduced.

An image forming apparatus according to the present invention is an image forming apparatus including (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image (e) a transfer device for transferring the visualized image onto a recording medium, and (f) a fixing device for fixing, to the recording medium, the developer transferred to the recording medium. In order to attain the object, the image forming apparatus is arranged such that the charging device includes a discharge electrode that is provided so as not contact with the image holding member, and a performing non-contact electrification by charging the image holding member by generating a corona discharge between the discharge electrode and the image holding member, and the image forming apparatus further includes a partitioning member for isolating (i) a space from an outside space, the space encompassing (a) the discharge electrode and (b) a part of the image holding member, which part faces the discharge electrode from (ii) the outside space; and a pressure reducing device for reducing a pressure of an isolated space below a pressure of the outside space.

The above structure prevents an increase in the humidity in the space between the discharge electrode and the image holding member, thereby avoiding a decrease in charging efficiency due to humidity. Further, by reducing the pressure of the space between the discharge electrode and the image holding member, (i) the discharge onset voltage can be reduced and (ii) charging efficiency can be improved. Further, by avoiding the decrease in the charging efficiency, it is possible to prevent an increase in the amount of ozone or nitride oxide generated.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3(*b*) is a plane diagram illustrating a main part of (i) the partition and (ii) the transporting roller, which partition and transporting roller are illustrated in FIG. 3(*a*).

FIG. 7(*b*) is a plane diagram taken along cross-section A-A of the charging device illustrated in FIG. 6, which cross-section A-A is viewed from an opposite side with respect to the side from which the cross-section is viewed in FIG. 7(*a*).

FIG. 13(*b*) is a diagram illustrating a structure of the heat pump illustrated in FIG. 13(*a*).

DESCRIPTION OF THE EMBODIMENTS

Figure 1:
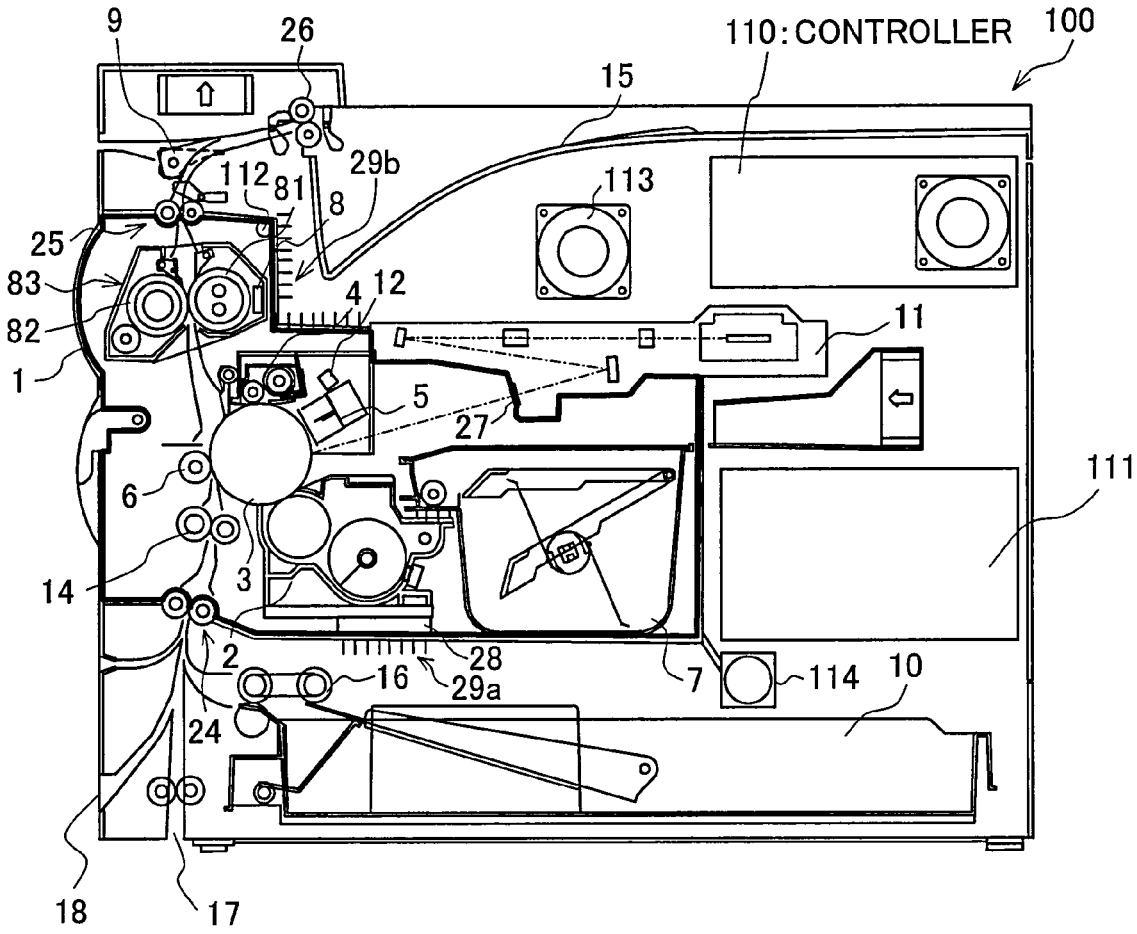
FIG. 1 is a cross sectional diagram of an image forming apparatus according to one embodiment of the present invention.

The following describes one embodiment of the present invention. FIG. 1 is a cross sectional diagram of an image forming apparatus 100 according to the present embodiment. The image forming apparatus 100 forms an image with the use of two-component developer containing toner (fine particle developer) and carrier. Further, the image forming apparatus 100 forms an image on a sheet (recording medium) in accordance with image data supplied by an external device.

Overall Structure of Image Forming Apparatus 100

As illustrated in FIG. 1, the image forming apparatus 100 includes processing units, that perform respective processes of image formation, such as a photoreceptor drum (image holding member) 3, a charging device 5, a light scanning unit 11, a developing unit (developing device) 2, a transfer device 6, a cleaning unit 4, a discharging (electrically discharging) lamp 12, and a fixing device 5. The charging device 5, the light scanning unit (latent image forming device) 11, the developing unit 2, the transfer device 6, the cleaning unit 4, and the discharging lamp 12 are provided, in the order as listed, along a rotational direction of the photoreceptor drum 3.

Further, the image forming apparatus 100 includes a partition (partitioning member) 1 for isolating (shielding, partitioning off) a space from the outer space (an outside space), the space encompassing the photoreceptor drum 3, the charging device 5, the developing unit 2, the transfer device 6, the cleaning unit 4, the discharging lamp 12, and the fixing device 8. The partition 1 will be specifically described later.

The image forming apparatus 100 further includes a pressure-reducing pump (pressure reducing apparatus) 114. The pressure-reducing pump 114 reduces the pressure inside of the partition 1 to a lower pressure than the pressure of the atmosphere surrounding the image forming apparatus 100. The pressure-reducing pump 114 sucks air, and toner contained in the air is eliminated by a toner filter before the pressure-reducing pump 114 carries out exhaust. Further, the pressure-reducing pump 114 exhausts moisture contained in the air within the partition 1, to the outside of the partition 1.

The charging device 5 evenly charges a surface of the photoreceptor drum 3 to allow the light scanning unit 11 to form an electrostatic latent image on the photoreceptor drum 3. The charging device 5 will be specifically described later.

The light scanning unit (latent image forming device) 11 (i) irradiates (exposes) the photoreceptor drum 3 with laser light and (ii) scans an optical image on the photoreceptor drum 3, which has been evenly charged, to write an electrostatic latent image onto the photoreceptor drum 3. The light scanning unit 11 performs the above processes in accordance with image data supplied by an external device that is connected to the image forming apparatus 100 so as to communicate with the image forming apparatus 100. The image forming apparatus 100 may include an image reading apparatus. In this case, the electrostatic latent image is formed in accordance with image data read by the image reading apparatus.

In the developing unit 2, the electrostatic latent image, which has been written onto the photoreceptor drum 3 by the light scanning unit 11, is visualized with the toner supplied from a toner replenishment container. As a result, a toner image (visualized image) is formed on the photoreceptor drum 3. The developing unit 2 will be specifically described later.

The transfer device 6 transfers (electrostatic transfer) the toner image, which has been visualized on the photoreceptor drum 3, to a sheet (recording medium).

The cleaning unit 4 removes residual toner from the photoreceptor drum 3 so that a new electrostatic latent image or a new toner image can be recorded on the photoreceptor drum 3. The discharging lamp 12 electrically discharges the surface of the photoreceptor drum 3.

The toner image which has been transferred onto the sheet is then fixed to the sheet by the fixing device 8. The fixing device 8 will be specifically described later.

A feeding tray 10 is provided in and underneath the image forming apparatus 100. The feeding tray 10 is installed in the main body of the image forming apparatus 100.

The feeding tray 10 is provided for storing sheets (recording medium). The sheets stored in the feeding tray 10 are separated one by one by members such as a pickup roller 16. Then, the respective sheets are fed, one by one, to a regist roller 14 through transporting rollers (transporting members) 24. Then, the regist roller 14 sequentially feeds the sheets to the space between the transfer device 6 and the photoreceptor drum 3. Each sheet is fed at such a timing that the toner image formed on the photoreceptor drum 3 is transferred onto a predetermined position on the sheet. Thereafter, the toner image which has been recorded and reproduced on the photoreceptor drum 3 is transferred onto the sheet.

Note that, when replenished with sheets, the feeding tray 10 is pulled out from a front side (operation side) of the image forming apparatus 100. Because the feeding tray 10 is provided outside of the partition 1, the feeding tray 10 can be replenished with sheets while the reduced pressure inside of the partition 1 is maintained (without releasing the inside of the partition 1 to the atmosphere).

Then, the sheet to which the toner image has been fixed by the fixing device 8, in other words the sheet on which the image is recorded, is further carried by a transporting rollers (transporting member) 25 to pass through a switch gate 9. Thereafter, if it is predetermined that sheets are to be ejected onto a stack tray 15, which is provided on the exterior of the image forming apparatus 100, then the sheet is ejected onto the stack tray 15 by reverse rollers 26.

Further, the image forming apparatus 100 includes a controller 110. The controller 110 includes substrates such as a circuit substrate (not illustrated) that controls operations of the respective members in the image forming apparatus 100, and an interface substrate (not illustrated) that receives image data from an external device. The interface communicates with an external device such as a personal computer and/or facsimile device via wireless communications or wire communications. This allows the image forming apparatus 100 to record, on a sheet, an image in accordance with data supplied by such an external device.

Further, the image forming apparatus 100 includes a power source 111 that supplies electric power to the respective members of the image forming apparatus 100.

Structure of Partition 1

The following describes the partition 1 in detail. As illustrated in FIG. 1, the partition 1 is provided to isolate a space from the outer space of the isolated space (outside of the isolated space), the space encompassing the photoreceptor drum 3, the charging device 5, the developing unit 2, the transfer device 6, the cleaning unit 4, the discharging lamp 12, and the fixing device 8. A material of the partition 1 is not particularly limited, but it is preferable that the partition 1 be made of a material having a high heat conductivity. If the partition 1 is made of such a material, then heat inside of the partition 1 would be radiated (released) efficiently to the outside. It is further preferable that the partition 1 be made of a material having adequate strength so that, the partition 1 would not be, for example, distorted or damaged even while the pressure inside of the partition 1 is reduced. To intensify the strength of the partition 1, a reinforcing member such as a rib or a reinforcing plate may be provided to the partition 1.

Further, the partition 1 is opened to expose the inside thereof when, for example, maintenance is performed on the members provided inside of the partition 1, or a paper jam occurs in the partition 1. The partition 1 has a conducting hole 112 for bringing reduced pressure inside of the partition 1 to atmospheric pressure. The conducting hole 112 is closed while in a normal state (while the pressure inside of the partition 1 is reduced). The conducting hole 112 is opened when the reduced pressure of the inside of the partition 1 is to be brought to the atmospheric pressure so as to have the same pressure as the pressure of the outside air. It may be arranged so that (i) an operation of opening the conduction hole 112 and, for example, (ii) a user operation of opening or closing a front cover (not illustrated) of the image forming apparatus 100 work (linked) with each other via means such as a link mechanism. The front cover is opened or closed in order to, for example, deal with paper jam, or in order to carry out maintenance with respect to the members in the partition 1. Alternatively, the controller 110 may cause a driving device (not illustrated) to open the conducting hole 112.

Figure 2:
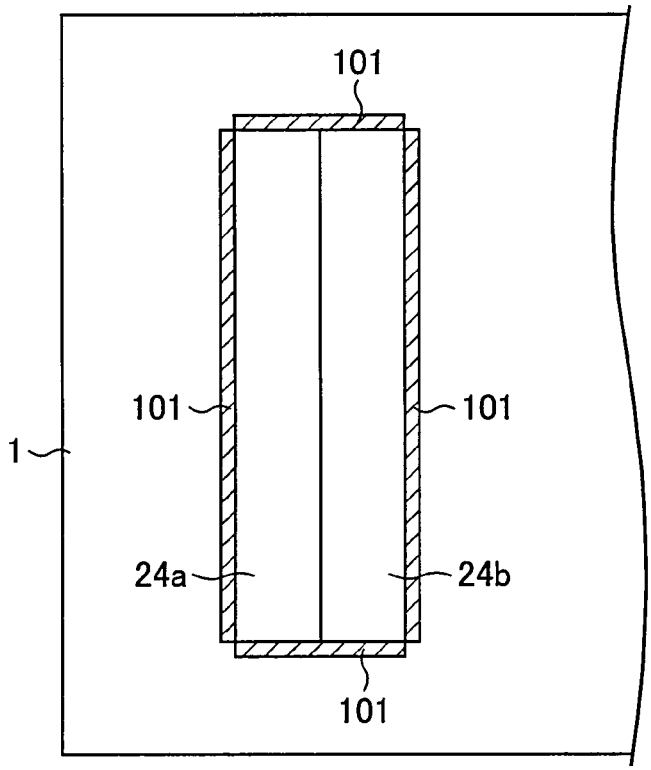
FIG. 2 is a plane diagram illustrating (i) a partition and (ii) a transporting roller of the image forming apparatus according to the embodiment of the present invention.

FIG. 2 is a plane diagram illustrating the transporting rollers 24 and the partition 1, taken from the upstream side in such a direction that the sheets are transported. As illustrated in the figure, the transporting rollers 24 includes two rollers, a roller 24*a* and a roller 24*b*, that are in contact with each other. A sheet is sandwiched between the rollers 24*a* and 24*b* while the rollers 24*a* and 24*b* rotate in opposite directions to each other, thereby transporting the sheet.

The roller 24*a* is made of a rigid material such as stainless steel, whereas the roller 24*b*, at least its face contacting with the roller 24*a*, is made of an elastic material such as rubber. This allows the sheet to be properly sandwiched between the rollers 24*a* and 24*b*, and ensures air-tightness between the rollers 24*a* and 24*b*. In other words, the air is prevented from entering into the partition 1 through a gap between the rollers 24*a* and 24*b*, and therefore it is possible to maintain the reduced pressure inside of the partition 1. Note that, although the roller 24*a* is made of a rigid material and the surface of the roller 24*b* is made of an elastic material in the present embodiment, the materials of the rollers 24*a* and 24*b* are not particularly limited to these materials. However, in order to assure that (i) the sheets are properly fed and (ii) the air-tightness of the partition 1 is ensured, it is preferable that a surface of at least one of the rollers 24*a* and 24*b* be made of an elastic material.

Further, a sealing material (sealing member) 101 is provided between (i) the rollers 24*a* and 24*b* and (ii) the partition 1. This prevents the outside air from entering into the partition 1 through the gap between (i) the rollers 24*a* and 24*b* and (ii) the partition 1, even while the rollers 24*a* and 24*b* are rotating. As such, it is possible to maintain the reduced pressure inside of the partition 1. A sealing material is similarly provided between transporting rollers 25 (a pair of rollers constituting the transporting rollers 25) and the partition 1. Details of (i) a sealing mechanism (sealing member) between the transporting rollers 24 and the partition 1 and (ii) a sealing mechanism (sealing member) between the transporting rollers 25 and the partition 1 will be described later.

On the partition 1, a transparent cover member (cover glass) 27 is provided with respect to a part through which laser light from the light scanning unit 11 is directed to the photoreceptor drum 3. The transparent cover member 27 is made of a material such as transparent glass. The light scanning unit 11 is provided outside of the partition 1 and the transparent cover member 27 is so provided that an optical path of the light scanning unit 11 passes the transparent cover member 27. This prevents floating toner (scattered toner) inside of the partition 1 from adhering to optical members of the light scanning unit 11 so as to contaminate the optical system of the light scanning unit 11. As such, accuracy in image formation is prevented from deteriorating. The transparent cover member 27 may be provided as a part of the partition 1. Alternatively, the transparent cover member 27 may be provided as a component of the light-scanning unit 11. For example, the transparent cover member 27 may be provided in the light scanning unit 11 so as to be attached to an aperture of the partition 1.

A heat radiating fin (heat radiating member) 29*a* is provided, underneath the developing unit 2, on an outer surface of the partition 1. Further, between the developing unit 2 and the partition 1, a heat transfer member 28 is provided so as to be in contact with the developing unit 2 and the partition 1. The heat transfer member 28 is made of a material, having a high heat transfer coefficient, such as aluminum.

Further, a heat radiating fin (heat radiating member) 29*b* is provided, in the vicinity of the fixing device 8, on an outer surface of the partition 1, (the heat radiating fin 29*b* is provided, on a lateral side of the fixing device 8, on the outer surface of the partition 1). The heat radiating fin 29*b* facilitates heat exchange between the inside and the outside of the partition 1. The image forming apparatus 100 further includes a fan (air blower) 113. Heat, which has been radiated to the outside of the partition 1 by the heat radiating fin 29*b*, is then released to the outside of the image forming apparatus 100 by the fan 113.

The heat transfer member 28 is only provided between the developing unit 2 and the partition 1 in the present embodiment. Meanwhile, another heat transfer member 28 may be provided between (i) an other member in the partition 1 and (ii) the partition 1. Further, although the heat radiating fins are provided only (i) under the developing unit 2 and (ii) on the lateral side of the fixing device 8 in the present embodiment, the present embodiment is not limited to this arrangement. Specifically, additional heat radiating fins may be provided around the partition 1. Further, the heat radiating member to be provided to the partition 1 is not limited to the heat radiating fin, as long as a heat radiating member can facilitate radiating heat from the inside of the partition 1 to the outside by, for example, enlarging the surface space of the partition 1.

Structure of Sealing Mechanism

The following specifically describes a sealing mechanism (sealing member) provided between the transporting rollers 24 and the partition 1. The same sealing mechanism is also provided between the transporting rollers 25 and the partition 1, although only the sealing mechanism between the transporting rollers 24 and the partition 1 will be described in this section.

Figure 3A:
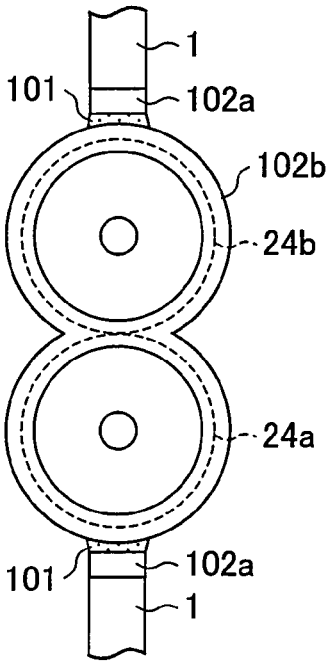
FIG. 3(*a*) is a cross sectional diagram of (i) the partition and (ii) the transporting roller of the image forming apparatus according to the embodiment of the present invention.
Figure 3B:
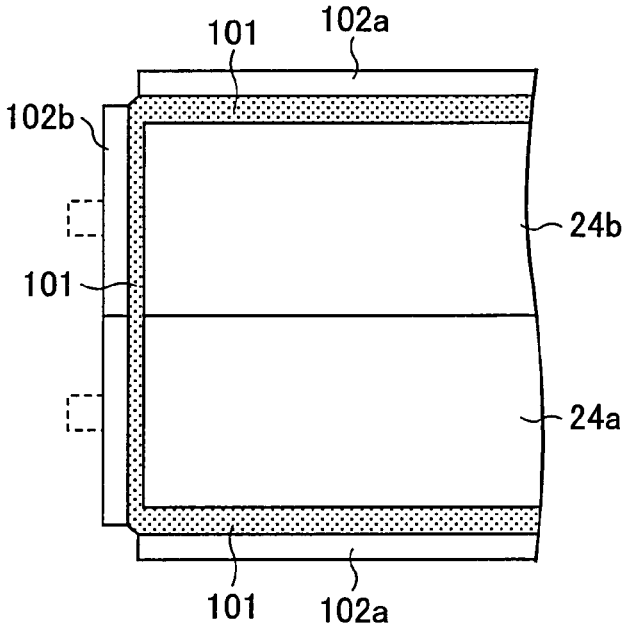
Figure 4:
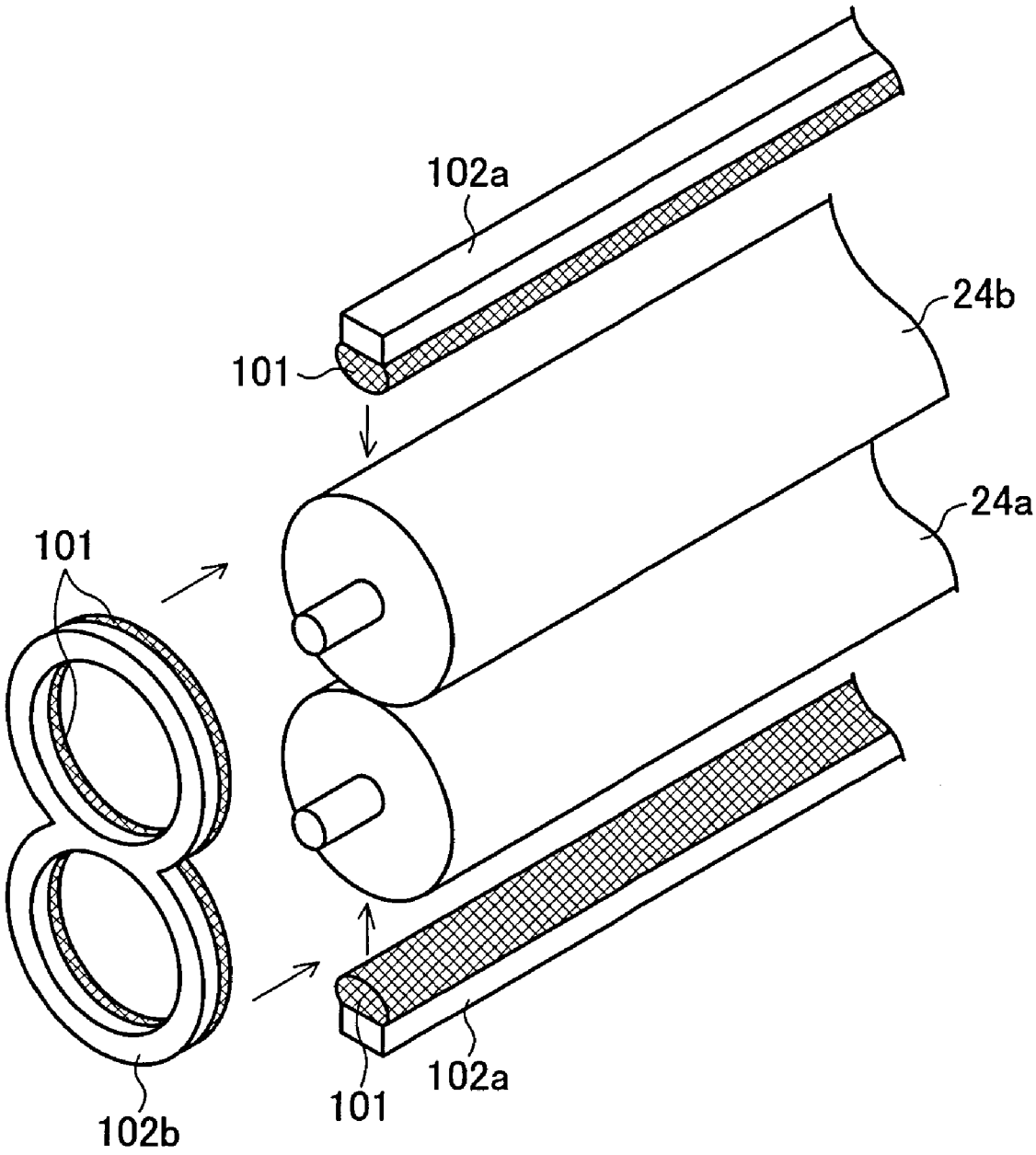
FIG. 4 is an exploded perspective diagram of (i) the partition and (ii) the transporting roller of the image forming apparatus according to the embodiment of the present invention.

FIG. 3(*a*) is a cross sectional diagram of the partition 1 and the rollers 24*a* and 24*b*. FIG. 3(*b*) is a plane diagram of the partition 1 and the rollers 24*a* and 24*b*. Finally, FIG. 4 is an exploded perspective diagram of the partition 1 and the rollers 24*a* and 24*b*.

As illustrated in these figures, the rollers 24*a* and 24*b* are provided at an aperture of the partition 1. A magnet 102*a* is provided at a part of the partition 1, which part faces a side surface of the rollers 24*a* and 24*b*. The magnet 102*a* extends along the partition 1. Further, a magnet 102*b* having a doughnut shape is provided at a part of the partition 1, which part faces both end surfaces, in the direction of rotation shafts, of the rollers 24*a* and 24*b*. The magnet 102*b* is so positioned to be superposed with circles formed by cross sections. The magnets 102*a* and 102*b* have an N-pole on the side facing the rollers 24*a* and 24*b*.

Further, the sealing material 101 is provided such that no gap is made between (i) the magnets 102*a* and 102*b* (partition 1) and (ii) the rollers 24*a* and 24*b*. The sealing material 101 is made of a magnetic fluid.

The magnetic fluid indicates a complex material in which ultra-fine ferromagnetic materials are evenly dispersed in a liquid. Neither agglomeration of particles nor solid-liquid separation occurs even under a strong magnetic field, and the magnetic fluid acts as if the liquid as a whole had ferromagnetism. More specifically, the magnetic fluid is a system in which high-density ferromagnetic ultra-fine particles such as magnetite are stably dispersed in a liquid. Normally, the magnetic fluid is composed of three components: liquid (base liquid) that acts as a medium; magnetic ultra particles; and surfactant chemically and strongly adsorbed on the surface of the magnetic ultra particles. The (i) vigorous thermal motion and (ii) mutual repulsion of a surfactant layer formed on the surface prevent aggregation of the ultra-fine particles, and therefore the ultra-fine particles are stably kept dispersed. For example, (i) water or (ii) hydrocarbon-based oil or fluorine-based oil, such as alkyl-naphthaline and perfluoro-polyether, is used as the medium. The followings may be used as the magnetic ultra-fine particles (ferromagnetic material): a magnetite having a particle diameter of approximately 10 nm; a Mn—Zn complex ferrite having a particle diameter of approximately 10 nm; or a rare-earth magnet having a particle diameter of approximately 10 nm. In the present embodiment, A-300 (product name) manufactured by Sigma HI-Chemical Inc. is used as the ferromagnetic fluid.

As described above, the gap between the transporting rollers 24 and the partition 1 is sealed by the sealing material made of magnetic fluid. This makes it possible to maintain the air-tightness of the partition 1 and thus prevent the outside air from entering into the partition 1 even during rotation of the transporting rollers 24 (rollers 24*a* and 24*b*). Therefore, the reduced pressure inside of the partition 1 is maintained.

Note that, although the sealing material 101 is made of the magnetic fluid in the present embodiment, the material of the sealing material 101 is not particularly limited to this, as long as the material ensures the air-tightness of the partition 1 even during rotation of the transporting rollers 24. For example, the sealing material 101 may be made of an elastic material such as rubber or urethane sheet. In this case, the sealing material 101 is provided between (i) a part of the partition 1, which part faces the transporting rollers 24, and (ii) the transporting rollers 24, and the magnets 102*a* and 102*b* are not necessary. Alternatively, a sealing material made of an elastic material and a sealing material made of magnetic fluid may be used in combination.

Structure of Charging Device 5

Figure 5:
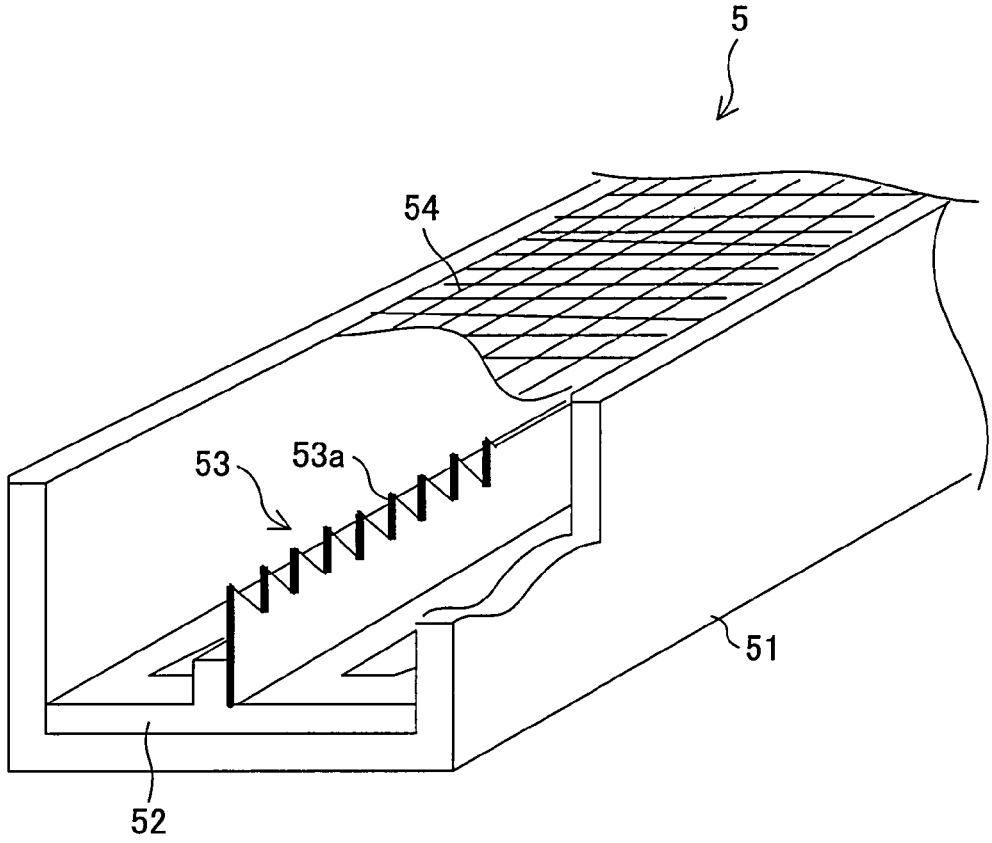
FIG. 5 is a perspective diagram illustrating a part of a charging device of the image forming apparatus according to the embodiment of the present invention.
Figure 6:
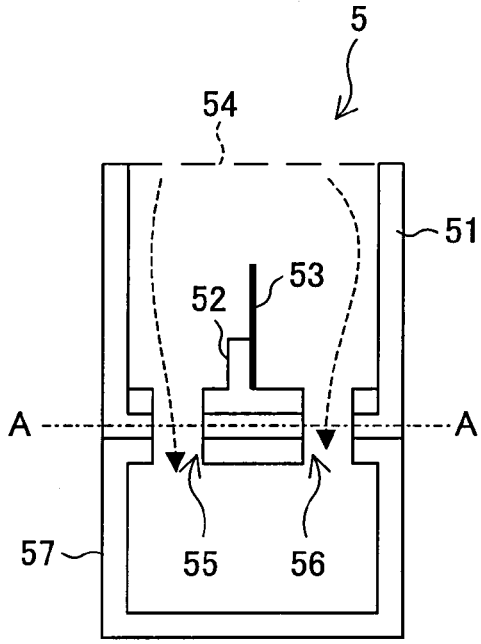
FIG. 6 is a cross sectional diagram of the charging device of the image forming apparatus according to the embodiment of the present invention.
Figure 7A:
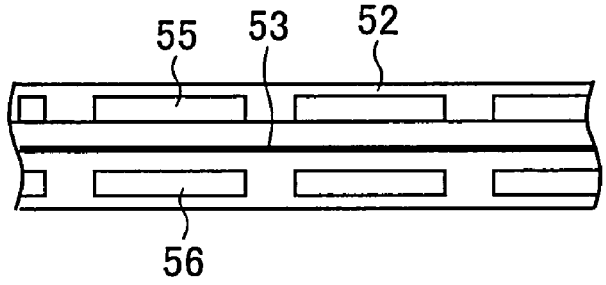
FIG. 7(*a*) is a plane diagram taken along cross-section A-A of the charging device illustrated in FIG. 6, which cross-section A-A is viewed from the photoreceptor drum 3 side.
Figure 7B:
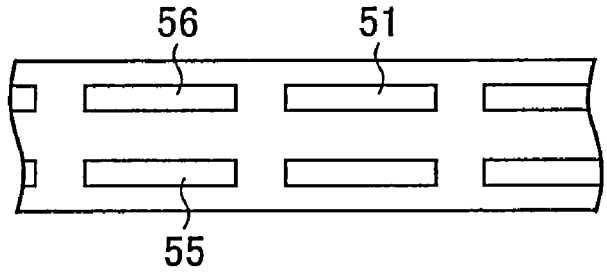
Figure 8:
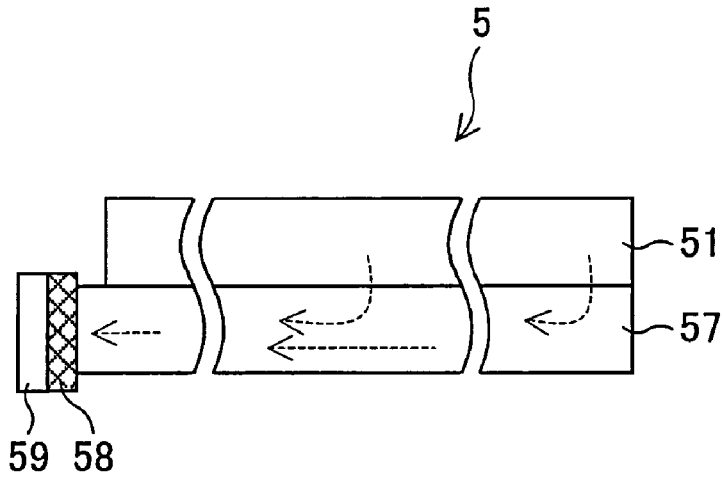
FIG. 8 is a lateral diagram of the charging device of the image forming apparatus according to the embodiment of the present invention.

The following specifically describes the charging device 5 of the image forming apparatus 100. FIG. 5 is a perspective diagram of the charging device 5. FIG. 6 is a cross sectional diagram of the charging device 5. FIG. 7(*a*) is a plane diagram taken along cross-section A-A shown in FIG. 6 from the photoreceptor drum 3 side. FIG. 7(*b*) is a plane diagram taken along cross-section A-A from an opposite side with respect to the side from which the cross-section is viewed in FIG. 7(*a*). Finally, FIG. 8 is a cross sectional diagram illustrating the charging device 5 from its lateral side.

As illustrated in FIG. 5, the charging device 5 includes a casing 51, a supporting member 52, a saw-tooth electrode (discharge electrode) 53, and a grid electrode 54.

The saw-tooth electrode 53 is a so-called charging electrode. The saw-tooth electrode 53 conducts discharging in response to an applied voltage. The saw-tooth electrode 53 includes a plurality of discharge electrodes 53*a*, each of which has a sharp tip. The discharge electrodes 53*a* are arranged in a predetermined direction, thereby forming a saw-teeth shape. Further, the saw-tooth electrode 53 is supported by the supporting member 52 of the casing 51 such that the tips (sharp points) of the discharge electrodes 53*a* face toward the photoreceptor drum 3 when the charging device 5 is attached to the image forming apparatus 100. When a voltage is applied to the saw-tooth electrode 53 by a high-voltage power source (not illustrated), corona discharge occurs between the saw-tooth electrode 53 and the photoreceptor drum 3.

In the casing 51, an opening part is provided so as to face the photoreceptor drum 3 when the charging device 5 is attached to the image forming apparatus 100. In other words, the casing 51 has the opening part on the side facing the tips of the discharge electrodes 53*a*. The grid electrode 54 is provided so as to cover the opening part.

The grid electrode 54 is realized by a wire mesh. The grid electrode 54 is connected to a power source (not illustrated) that is different from the high-voltage power source connected to the saw-tooth electrode 53. The power source supplies the grid electrode 54 with a bias voltage (grid voltage), and the grid electrode 54 controls a corona ion flux in accordance with the bias voltage so as to adjust the amount of ions that are to reach the photoreceptor drum 3.

As illustrated in FIG. 6, the casing 51 includes a duct 57, which is provided on a surface of the casing 51 opposite to the grid electrode 54. Apertures 55 and 56 are provided in a surface of the casing 51 and the supporting member 52 on which surface the duct 57 is provided (see FIGS. 6, 7(*a*), and 7(*b*)).

The duct 57, as illustrated in FIG. 8, has one closed end in the longitudinal direction. The other end is equipped with an ozone filter 58 and a fan 59.

The ozone filter 58 takes in (absorbs) ozone generated in the charging device 5 as a result of discharge. For example, an ozone filter utilizing activated carbon such as KF honeycomb ozone filter (product name) manufactured by Toyobo Co., Ltd.) is used as the ozone filter 58.

The fan 59 takes in the air in the duct 57 and exhausts the air to the outside of the charging device 5 through the ozone filter 58. The air may be exhausted either to the inside or to the outside of the partition 1, as long as the air is exhausted to the outside of the charging device 5. In the case where the air is exhausted to the outside of the partition 1, the fan 59 may function as a pressure reducing device for reducing the pressure in the partition 1.

In the above structure, as indicated by the broken lines in FIGS. 6 and 8, the air is taken into the casing 51 through the opening part facing the photoreceptor drum 3 (opening part over which the grid electrode 54 is provided.). The air is then led to the duct 57, after passing by the periphery of the saw-tooth electrode 53. Thereafter, ozone contained in the air is absorbed and removed by the ozone filter 58. Finally, the air is exhausted to the outside of the charging device 5.

With the above structure, the ozone generated in the charging device 5 (saw-tooth electrode 53) as a result of corona discharge is prevented (i) from being exhausted to the photoreceptor drum 3 and (ii) from staying in the partition. As such, the ozone will not reach the surface of the photoreceptor drum 3. As such, generation of nitrogen oxide is prevented.

Although the ozone filter utilizing activated carbon is used in the present embodiment, the ozone filter 58 is not particularly limited to this, as long as the ozone filter 58 can remove the ozone. For example, an ozone filter, utilizing a catalyst, such as CAO filter (product name) manufactured by Toyobo Ltd. may be used. Alternatively, in place of the ozone filter 58, a member that decomposes ozone into non-contaminant may be provided.

Further, although the present embodiment employs a charging device 5 including the duct 57, the ozone filter 58, and the fan 59, the charging device 5 is not particularly limited to this. A charging device without these components may be used as the charging device 5.

Further, although the charging device of corona discharge (charging device of non-contact electrification) is used in the present embodiment, the charging device is not limited to this type of charging device, and a charging device of contact electrification may also be used. For example, in place of the charging device of corona discharge, a charging roller (charging device), which is an exemplary charging device of contact electrification, may be provided. Besides the charging roller, a charging device including a charging brush may also be used as the charging device of contact electrification.

Even in the case where the charging device of contact electrification is employed, it is preferable that components such as the duct 57, the ozone filter 58, and the fan 59 be provided so that the fan 59 directs the air in the vicinity of the charging roller toward the ozone filter 58. This makes it possible to absorb and remove ozone from the charging device. It is thus ensured more definitely that the ozone is prevented from reaching the surface of the photoreceptor drum 3 due to the ozone staying in the partition 1 or due to other reasons.

Structure of Developing Unit 2

Figure 9:
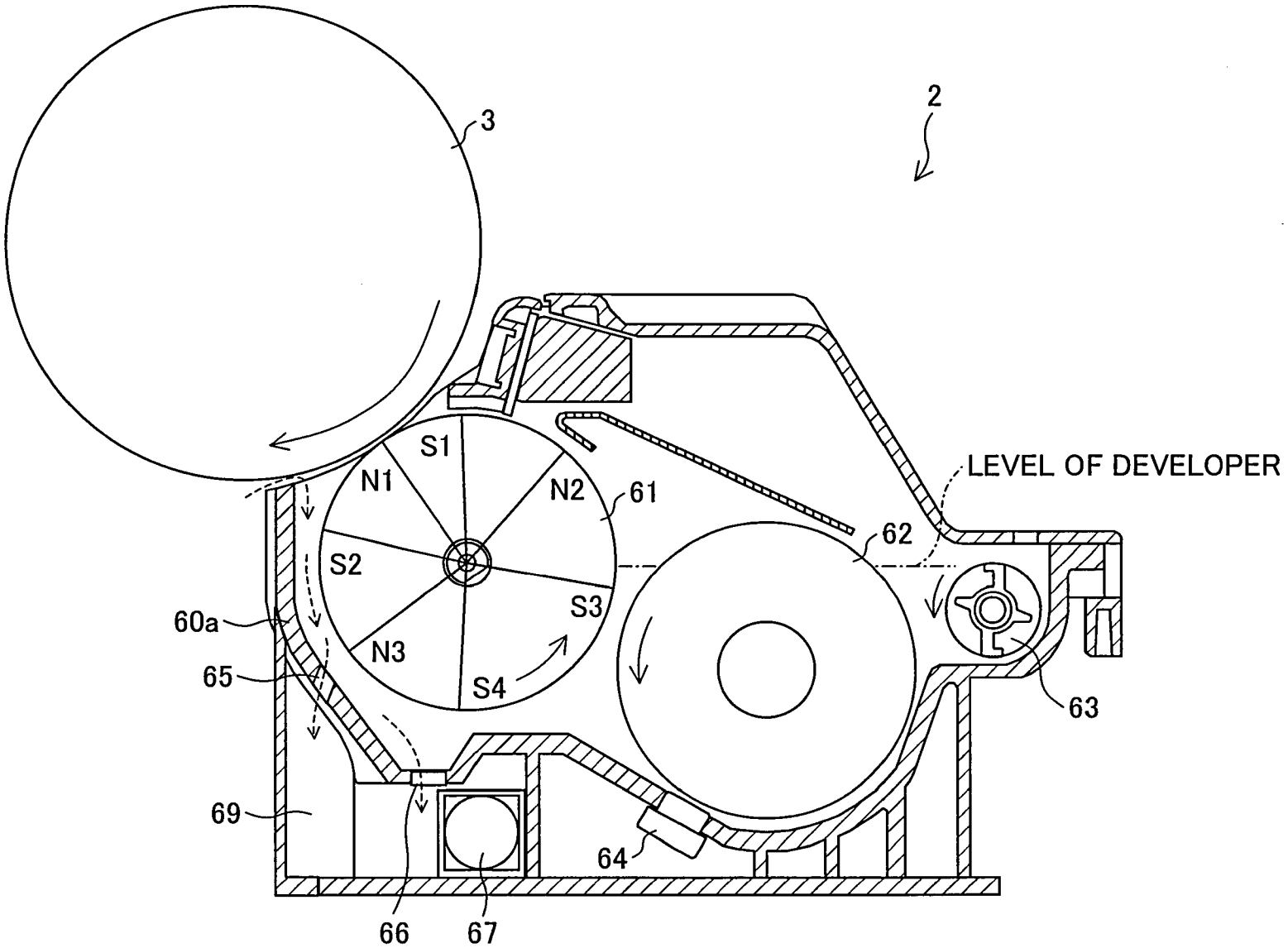
FIG. 9 is a cross sectional diagram of a developing unit of the image forming apparatus according to the embodiment of the present invention.

The following specifically describes the developing unit 2 of the image forming apparatus 100. FIG. 9 is a cross sectional diagram schematically illustrating a structure of the developing unit 2.

As illustrated in the figure, the developing unit 2 includes members such as a development roller 61, stirrer rollers 62 and 63, a toner concentration sensor 64, a development tank 60*a*, and a fan 67.

The development tank 60*a* is a container used for accommodating toner and carrier. In the development tank 60*a*, the development roller 61 and the stirrer rollers 62 and 63 are provided. Further, the toner concentration sensor 64 is provided on the development tank 60*a* in such a way as to face the stirrer roller 62. The development tank 60*a* has an aperture above the stirrer roller 63. Through the aperture, the toner replenishment container 7 supplies toner.

Further, the development tank 60*a* is provided close to the photoreceptor drum 3. The development tank 60*a* has an opening which faces the photoreceptor drum 3. There is a spacing of 2 mm or smaller between (i) an edge portion of the opening, which edge portion is downstream in the rotation direction of the photoreceptor drum 3, and (ii) the photoreceptor drum 3. By making the spacing 2 mm or smaller, it becomes possible to restrain the airflow, caused by the rotation of the photoreceptor drum 3, from the inside of the development tank 60*a* to the outside of the development tank 60*a*. Therefore, scattering of toner is prevented.

The development roller 61 is a cylindrical roller that rotates. The development roller 61 is partially exposed in the opening of the development tank 60*a*, which opening faces the photoreceptor drum 3. The exposed part of the development roller 61 thus faces the photoreceptor drum 3. The development roller 61 carries and directs the toner contained in the development tank 60*a* to the exposed part facing the photoreceptor drum 3. This causes the toner to be adhered to an electrostatic latent image formed on the photoreceptor drum 3, so that the electrostatic latent image on the photoreceptor drum 3 is developed. As a result, a toner image is formed. The development roller 61 rotates in the direction indicated by the arrow illustrated in FIG. 9.

The stirrer rollers 62 and 63 stir the toner contained in the development tank 60*a* so as to (i) slightly charge the toner and (ii) direct the toner to the development roller 61.

The toner concentration sensor 64 (i) detects a concentration of the toner contained in the development tank 60*a* and (ii) transmits a detected result to the controller 110. On the basis of the detected result, the controller 110 (i) drives a replenishment roller (not illustrated) provided to the toner replenishment container 7 and (ii) causes the toner replenishment container 7 to supply a necessary amount of toner to the development tank 60*a*.

The fan 67, as indicated by the broken arrow in FIG. 9, sucks the air inside the development tank 60*a*, and exhausts the air thus sucked to the outside of the developing unit 2. As such, the air in the vicinity of the development tank 60*a* enters into the development tank 60*a* through an empty space between the photoreceptor drum 3 and the development tank 60*a*. The air may be exhausted, for example, to the inside of the partition 1 or to the outside of the partition 1, as long as the air is exhausted to the outside of the developing unit 2. In the case where the air is exhausted to the outside of the partition 1, the fan 67 may function as a pressure reducing device for reducing the pressure inside of the partition 1.

Figure 10:
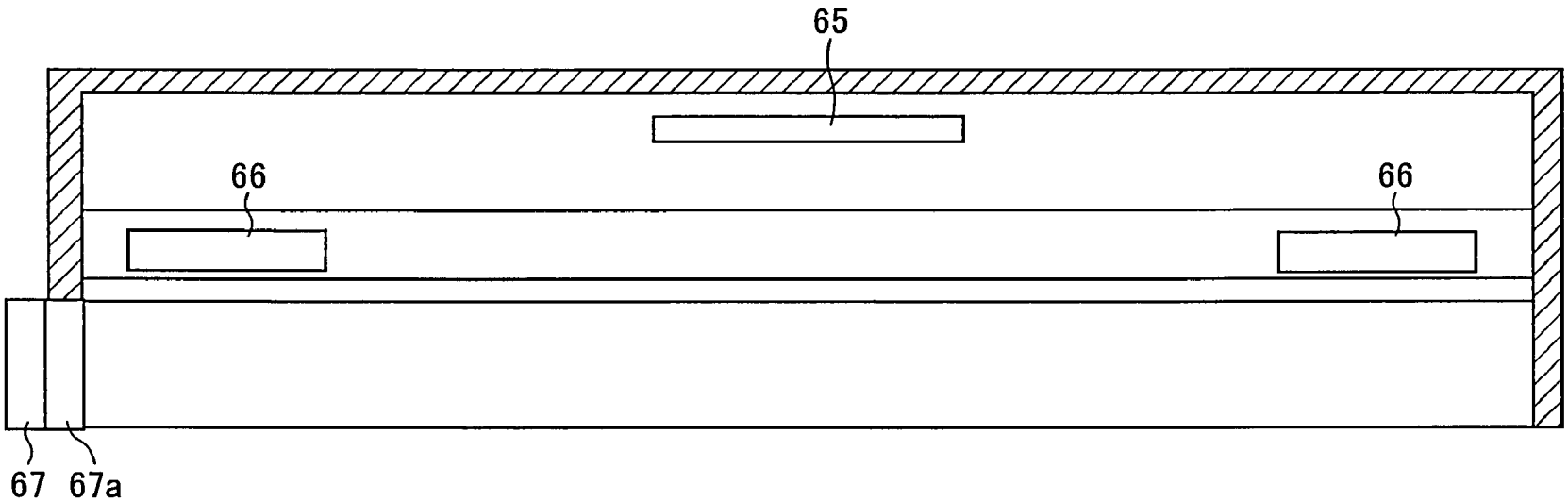
FIG. 10 is a plane diagram illustrating a part of the developing unit of the image forming apparatus according to the embodiment of the present invention.

In the development tank 60*a*, an exhaust duct 69 is provided under the development roller 61. The exhaust duct 69 extends substantially entirely in the direction of (i) the shaft of the photoreceptor drum 3 and (ii) the shaft of the development roller 61. Further, the development tank 60*a* has a central inlet 65 and end inlets 66, which central inlet 65 and end inlets 66 face the exhaust duct 69. FIG. 10 is a plane diagram illustrating a part of the development tank 60*a* from the development roller 61 side, which part includes the central inlet 65 and the end inlets 66. As illustrated in the figure, the central inlet 65 is provided in the vicinity of the center of the development tank 60*a* in the longitudinal direction of the development roller 61, whereas the end inlets 66 are provided in the respective vicinities of both end parts of the development tank 60*a* in the longitudinal direction of the development roller 61. Further, as also illustrated in the figure, a toner filter (developer removing member) 67*a* and a fan 67 are provided on a side face of the exhaust duct 68.

After having entered the development tank 60*a* through the space between the photoreceptor drum 3 and the development tank 60*a*, the air passes by the development roller 61 and enters the exhaust duct 69 through (i) the central inlet 65 in the lower face of the development tank 60*a* and (ii) the both-ends inlets 66 in the lower face of the development tank 60*a*. Then, the toner filter 67*a* removes toner (collects dust) from the air. Thereafter, the air is exhausted to the outside of the developing unit 2.

Note that, although the present embodiment employs the developing unit 2 that includes the fan 67, the toner filter 67*a*, and the exhaust duct 69, the developing unit 2 is not limited to this type of developing unit. A developing unit without these components may also be employed as the developing unit 2.

Structure of Fixing Device 8

The following specifically describes the fixing device 8 of the image forming apparatus 100. As illustrated in FIG. 1, the fixing device 8 is provided with a fixing roller 81 and a pressure roller 82. The fixing device 8 sequentially receives sheets onto which the transfer device 6 has transferred toner images. Each of the sheets is transported to an space between the fixing roller 81 and the pressure roller 82. Then, the toner image (developed image) that has been transferred onto the sheet is fixed to the sheet by heat and pressure. As a result, the image is recorded on the sheet.

Figure 11:
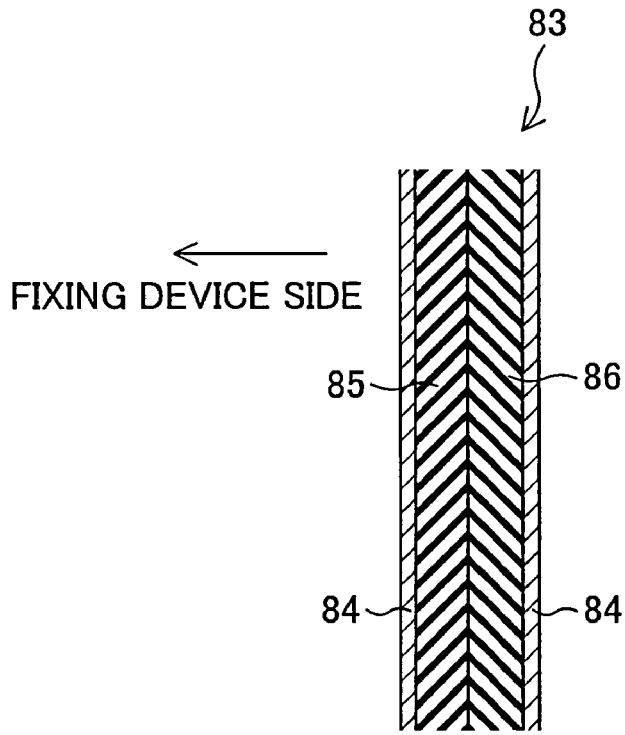
FIG. 11 is a cross sectional diagram illustrating an exemplary structure of a heat insulating wall provided around a fixing device of the image forming apparatus according to the embodiment of the present invention.

Further, as illustrated in FIG. 1, the fixing device 8 is surrounded by a heat insulating wall (heat insulating member, vacuum heat insulating member) 83. FIG. 11 is a cross sectional diagram illustrating a main part of the heat insulating wall 83. As illustrated in the figure, the heat insulating wall 83 includes outer walls (exterior wrapping material) 84, a first layer (spacer material) 85, and a second layer (spacer material) 86. The first layer 85 and the second layer 86 are formed between the outer walls 84. The inside of the outer walls 84 is sealed under vacuum. The first layer 85 is made of inorganic micro powder such as silica, pearlite, calcium silicate, diatomaceous earth or the like). The first layer 85 is positioned on the fixing device 8 side, compared to the second layer 86. Further, the spacer material 86 is made of, for example, open-celled urethane foam. The spacer material 86 is not limited to expandable urethane foam having communicating bubbles, and may be organic or inorganic. It is, however, preferable to use an spacer material having holes that (i) are sufficiently small in diameter and (ii) communicate one side with the other side completely.

With such heat insulating wall 83, heat in the fixing device 8 is prevented from radiated into the inside of the partition 1, and therefore the temperature inside of the partition 1 is prevented from increasing. Furthermore, heat in the fixing roller 81 or the pressure roller 82 is prevented from (i) reaching to, for example, a driving system (not illustrated) of the fixing device 8 and therefore (ii) causing negative influences.

Figure 12:
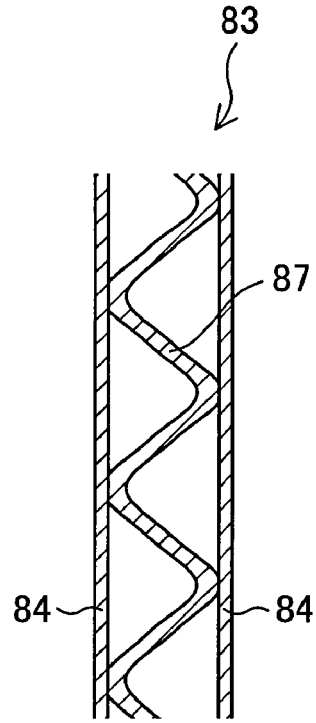
FIG. 12 is a cross sectional diagram illustrating another structure of the heat insulating wall provided around the fixing device of the image forming apparatus according to the embodiment of the present invention.

The structure of the heat insulating wall 83 is not limited to the structure illustrated in FIG. 11. For example, as illustrated in FIG. 12, the heat insulating wall 83 may be provided with a wave-shaped spacer material 84*a* in a hollow sealed by the outer wall (exterior wrapping material) 84, and the hollow may be vacuumed. In this case, the outer wall 84 and the spacer material 84*a* may be made of metal material (e.g., stainless steel), and the portions where the spacer material 84*a* and the outer wall 84 come into contact with each other may be connected by spot-welding. Alternatively, in place of the spacer material 84*a*, a spacer (not illustrated) made of, for example, glass beads may be used. Further, in the above structure, the heat insulating wall 83 employs a vacuum heat insulating wall (vacuum heat insulating member) in which the inside of the exterior wrapping material is vacuumed and sealed. The heat insulating wall 83, however, is not limited to this structure, and may employ a reduced-pressure heat insulating material in which (i) the inside of the exterior wrapping material is sealed under pressure reduced below the atmosphere pressure. Further, besides the heat insulating members described above, a variety of heat insulating member are applicable.

Further, the fixing device 8 may be provided with a heat recycling mechanism that (i) collects heat passed through the heat insulating wall 83 and radiated to the inside of the partition 1 and (ii) supplies collected heat energy to the fixing roller (heating member) 81 and/or the pressure roller (heating member) 82. As the heat recycling mechanism, for example, as illustrated in FIG. 13(*a*), a heat pump 87 provided in the vicinity of the fixing device 8 may be used.

Figure 13:
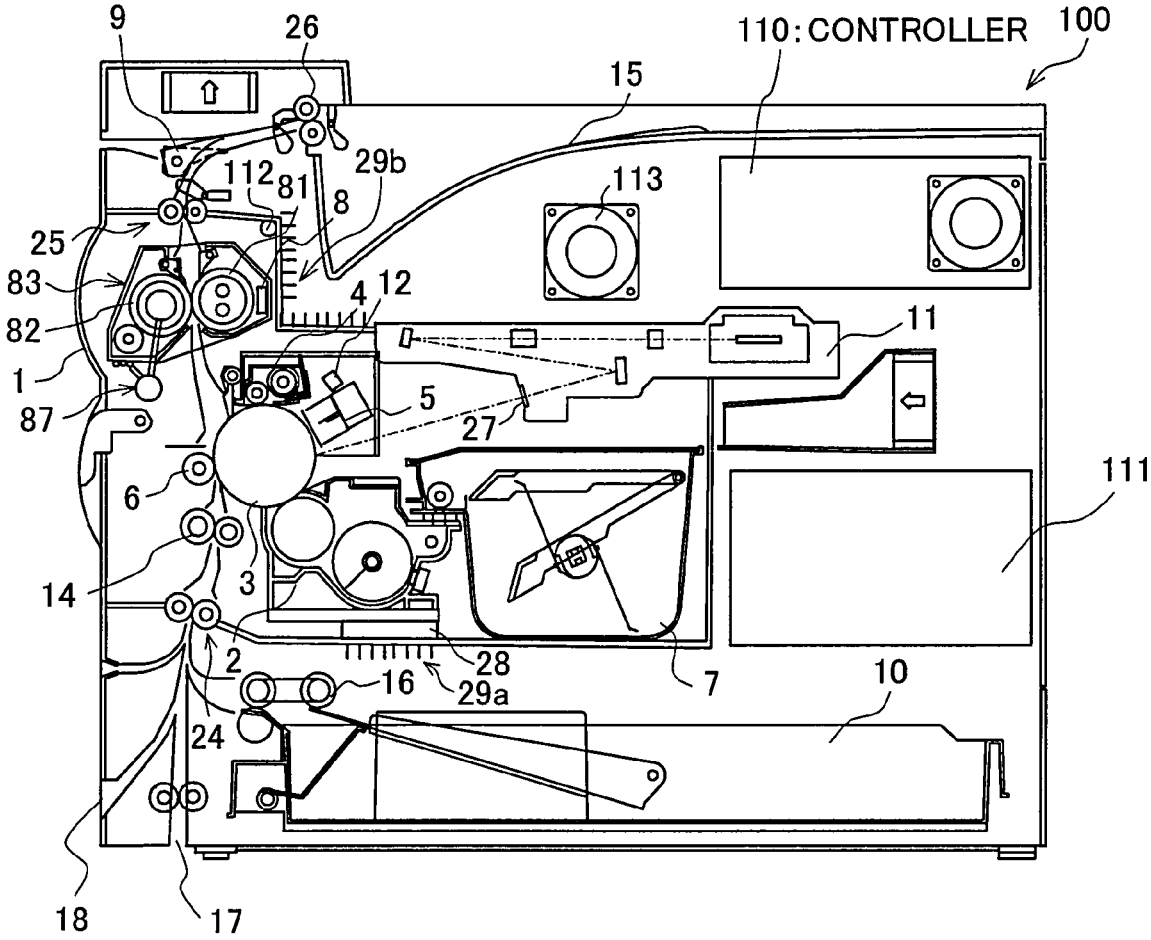
FIG. 13(*a*) is a cross sectional diagram illustrating an exemplary structure of the image forming apparatus according to the embodiment of the present invention, in a case where the fixing device is equipped with a heat pump.
Figure 13:
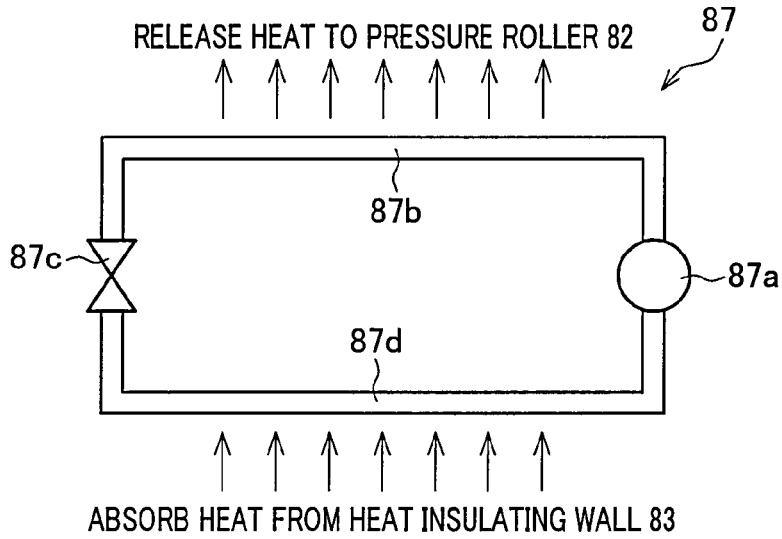

FIG. 13(*b*) is an explanatory diagram schematically illustrating a structure of the heat pump 87. As illustrated in the figure, the heat pump 87 is provided with a compressor 87*a*, a heat releasing section 87*b*, an expansion valve 87*c*, and a heat absorbing section 87*d*. Inside of the heat pump 87, working fluid (not illustrated) is enclosed.

The compressor 87*a* compresses the working fluid that is in a saturated vapor state. After having compressed into liquid by the compressor 87*a*, the working fluid is sent to the heat releasing section 87*b*. The heat releasing section 87*b* is provided either in the vicinity of the pressure roller 82 or inside of the pressure roller 82. The heat releasing section 87*b* exchanges heat between the working fluid and the pressure roller 82 so as to release the heat from the working fluid to the pressure roller 82. After having released the heat and having been cooled in the heat releasing section 87*b*, the working fluid becomes saturated liquid and is sent to the expansion valve 87*c*. After having expanded in the expansion valve 87*c*, the working fluid becomes wet vapor and is sent to the heat absorbing section 87*d*. The heat absorbing section 87*d* is provided in the vicinity of the heat insulating wall 83, and causes the working fluid to absorb the heat that has passed through the heat insulating wall 83 from the inside of the fixing device 8. After having absorbed the heat from the heat insulating wall 83 in the heat absorbing section 87*d*, the working fluid becomes saturated vapor again and is sent back to the compressor 87*a*. Then, the series of the above processes is repeated.

As described above, the heat pump 87 (i) collects heat having passed through the heat insulating wall 83 from the fixing device 8 and (ii) supplies the collected heat to the pressure roller 82. This makes it possible to save energy used for heating in the fixing device 8. Therefore, the power consumption is reduced.

Further, with regard to a gear (gear train), which is not illustrated, for driving the fixing roller 81 and the pressure roller 82, it is preferable that the gear be made of a material having a low heat conductivity. For example, the gears may be prepared by molding PPS (polyphenylene sulfide) in which hollow glass spheres (e.g. Scotch Light (product name) produced by Sumitomo 3M) of approximately 30 μm to 70 μm in particle diameter are mixed at a volume ratio of 20% to 30%. PPS is a heat resistant material. Glass fillers may be mixed in PPS as needed in order to improve the strength.

As described above, the image forming apparatus 100 includes a partition 1 and a pressure-reducing pump 14. The partition 1 isolates (shields) (a) the space where the photoreceptor drum 3, the charging device 5, the developing unit 2, the transfer device 6, and the fixing device 8 are provided, from (b) the outside space of the partition 1. The pressure-reducing pump 114 exhausts the air inside of the partition 1 to the outside of the partition 1 thereby reducing the pressure inside of the partition 1 to a pressure below atmosphere pressure (pressure of the outside of the partition 1).

With the above structure, it is possible to prevent an increase in the humidity inside of the partition 1. Specifically, by reducing the pressure, a partial pressure of the water vapor inside of the partition 1 is reduced. As a result, the partial pressure tends to change toward saturated vapor pressure (a pressure of water vapor in a state where the water vapor in the air is in equilibrium). The saturated vapor pressure is dependent on the temperature. This is utilized to facilitate evaporation of the moisture having been absorbed by, for example, papers or toner. Furthermore, by exhausting the air that contains water vapor to the outside of the partition 1, the humidity inside of the partition 1 is reduced. Therefore, deterioration in image quality or reduction in processing efficiency, both of which are caused by an increase in the temperature inside of the image forming apparatus, is prevented. Furthermore, for example operation defects due to water vapor condensed on the photoreceptor or the optical system are also prevented.

Specifically, by reducing the pressure inside of the space including (i) the charging device 5 and (ii) the space in contact with a part of the photoreceptor drum 3, which part faces the charging device 5, it is possible to prevent an increase in the humidity in the space between (a) the discharge electrode (charging member) 53*a* of the charging device 5 and (b) the photoreceptor drum 3. Therefore, deterioration in charging efficiency due to humidity can be prevented. Further, by reducing the pressure inside of the space between the discharge electrode 53*a* and the photoreceptor drum 3, the discharge onset voltage can be reduced. Therefore, charging efficiency is improved in accordance with Paschen's law. Further, because the deterioration in charging efficiency is prevented, it is possible to prevent an increase in the amount of generated ozone or nitride oxides.

Further, the humidity increased in the space including (i) the developing unit 2 and (ii) the space in contact with a part of the photoreceptor drum 3, which part faces the developing unit 2, is prevented. This makes it possible to avoid a situation in which (i) toner absorbs moisture, then (ii) a resistance of the toner decreases, and therefore (iii) the amount of charges of the toner decreases. Further, the air resistance of the toner may be reduced to shorten the time the toner flies in the air, so that the airborne toner is collected efficiently. Therefore, for example, even by downsizing the toner in order to improve image quality, it is possible to attain efficient collection of the airborne toner. Further, airflows due to the rotation of, for example, the development roller, the stirrer roller, or the photoreceptor drum can be prevented, and therefore the scattering of the toner can be prevented. Therefore, even in the case where, for example, the rotation speed of the photoreceptor drum is speeded up to increase the processing speed (to increase the number of sheets that can be treated per unit time in the image formation), the airflows due to the rotation is restrained, thereby preventing the toner from scattering. Further, by reducing the pressure inside of the partition 1, the toner is prevented from spouting out of the partition 1.

Further, by reducing the pressure inside of the space including (i) the transfer device 6 and (ii) an space in contact with a part of the photoreceptor drum 3, which part faces the transfer device 6, it is possible to reduce a humidity-caused change in a resistance of, for example, the transfer member, a paper path (space between the transfer device 6 and the photoreceptor drum 3), a sheet, or toner. Therefore, it is possible to prevent deterioration in the transfer efficiency.

Further, by reducing the pressure inside of the space including the fixing device 8, a humidity-caused change in the heat conductivity of the members of the fixing device 8, a sheet, or toner, is reduced. Therefore, it is possible to prevent (i) deterioration in fixing performance due to the change in heat conductivity and (ii) a decrease in efficiency of utilizing heat energy. Furthermore, air convection in the fixing device 8 is reduced, and therefore heat dispersion due to the air convection is prevented. This makes it possible to reduce waste of heat energy.

Although (i) the partition 1 isolates, from the outside thereof, the space where the photoreceptor drum 3, the charging device 5, the developing unit 2, the transfer device 6, and the fixing device 8 are provided and (ii) the pressure inside of the partition 1 is reduced in the present embodiment, the space to be surrounded by the partition 1 is not limited to the space described above. In other words, the space where the pressure is to be reduced is not limited to space described above. It is sufficient to reduce the pressure of at least one of (a) an space including (i) the discharge electrode of the charging device 5 and (ii) a part of the photoreceptor drum 3, which part faces the discharge electrode, (b) an space including (i) the developing unit 2 and (ii) a part of the photoreceptor drum 3, which part faces the developing unit 2, (c) an space including (i) the transfer device 6 and (ii) a part of the photoreceptor drum 3, which part faces the transfer device 6, and (d) an space including the fixing device 8. Considering which space is to be put under reduced pressure, (i) the partition 1 is provided, (ii) a desired space is isolated from the outside, when necessary, by using, for example, a sealing mechanism utilizing the magnetic fluid, or a sealing mechanism made of an elastic member (e.g., rubber, urethane sheet), and (iii) a pressure reducing device is provided in order to reduce the pressure inside of the isolated space.

Further, although the pressure-reducing pump (pressure reducing device) 114 reduces the pressure inside of the partition 1 in the present embodiment, the pressure reducing device is not limited to such pressure-reducing pump, as long as the pressure inside of the partition 1 can be reduced properly. For example a pressure-reducing fan or a vacuum pump may be employed. Further, the pressure inside of the partition 1 when the pressure has been reduced is not particularly limited, as long as the pressure is lower than the atmosphere pressure in the vicinity of the image forming apparatus 100.

While the pressure inside of the partition 1 is reduced, it is preferable that the pressure be not less than 0 KPa but not more than 30 KPa. This promotes significant effects in that: (i) the discharge onset voltage is reduced in the charging device 5, and generation of ozone is prevented in the charging device 5; (ii) efficiency of utilizing heat in the fixing device 8 is improved by restraining heat transfer due to convection in the fixing device 8; and (iii) the scattering of the toner inside of the partition 1 is reduced by reducing the airflows.

Further, while the pressure inside of the partition 1 is reduced, it is preferable that the pressure be not less than 0 KPa but not more than 5 KPa. This facilitates more effective evaporation of the moisture contained in a sheet or toner, in addition to the effects mentioned above. Therefore, the humidity inside of the partition 1 can be maintained even at a lower level.

Figure 14:
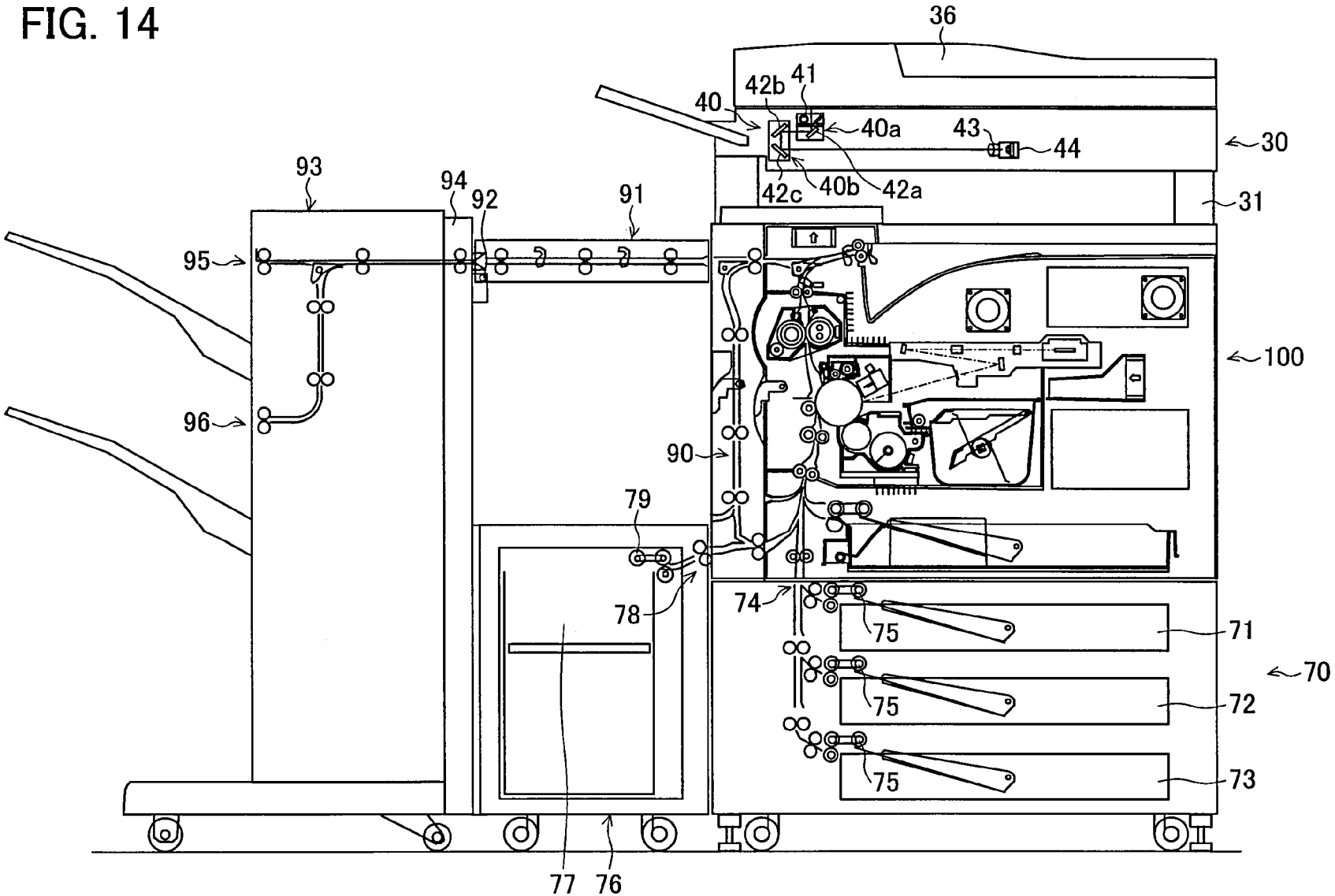
FIG. 14 is a cross sectional diagram illustrating an exemplary structure of the image forming apparatus according to the embodiment of the present invention, in a case where various extension devices are connected to the image forming apparatus.

Further, a variety of peripheral devices may be installed as an extension device. For example, as illustrated in FIG. 14, an image reading apparatus (image reading apparatus, optical system for reading) 30, a recording medium feeder 70, a recording medium feeder 76, a recording medium re-feeding transport device 90, a relaying transport unit 91, a post-processing apparatus or the like may be detachably provided. Further, the controller 110 can link and overall control (i) the operations of the respective sections of the image forming apparatus 100 and (ii) the operations of the extension devices that are installed.

The image reading apparatus 30, as illustrated in FIG. 14, includes: a document plate 35 made of transparent glass; an automatic document feeder 36 for automatic transport of a document to the document plate 35; and a scanner unit 40, which is a document image reading unit that scans and reads an image of the document placed on the document plate 35. In the image reading apparatus 30 structured as described above, the following processes are performed. First, an image of the document placed on the document plate 35, which is transparent, is exposed to light, scanned to form a light image on a photoelectric device so as to convert the light image of the document into an electric signal. Thereby, the document image is converted in to the electric signal. The electric signal is transmitted as image data, to the image forming apparatus 100. Thereafter, a predetermined process is performed on the image data.

The automatic document feeder 36 automatically feeds documents, one by one, onto the document plate 35 from a predetermined document tray (not illustrated) where a plurality of documents are stacked in advance. After the scanner unit 40 has read the image of a document, the automatic document feeder 36 transports the document to a predetermined section from which the document is to be taken out.

The scanner unit 40 is a document image reading unit that reads, line by line, the image of the document having transported to the document plate 35. As illustrated in FIG. 14, the scanner unit 40 is provided with a first scan unit 40*a*, a second scan unit 40*b*, an optical lens 43, and a CCD 44.

The first scan unit 40*a* exposes the document to light, while moving at a constant velocity V from the left to the right along the document plate 35. As illustrated in FIG. 14, the first scan unit 40*a* is provided with (i) a lamp reflector assembly 41 that emits light and (ii) a first reflecting mirror 42*a* that leads reflected light from the document to the second scan unit 40*b*.

The second scan unit 40*b* and moves at a velocity V/2 following the first scan unit 40*a*. The second scan unit 40*b* is provided with a second reflecting mirror 42*b* and a third reflecting mirror 42*c*, both of which lead light reflected by the first reflecting mirror 42*a* toward the optical lens 43 and the CCD 44.

Light reflected by the third reflecting mirror 42*c* is focused on the CCD 44 by the optical lens 43.

The CCD (charge coupled device; photoelectric device) 44 converts the light focused thereon by the optical lens 43 into an electric signal (electrical image signal). A CCD board (not illustrated) equipped with the CCD 44 converts, into image data represented by digital signal, the analog electric signal created by the CCD 44. Then, an image processing section performs a variety of image processes on the image data, and thereafter the image data is stored in a memory (not illustrated). Then, the image data is transmitted to the image forming apparatus 100 in accordance with an instruction of the controller 110.

Further, the automatic document feeder includes a coherence imaging sensor (CIS) (not illustrated) that integrally includes, for example, (i) a light source that exposes an upper surface of the document to light, (ii) an optical lens that leads an optical image to a CCD, and (iii) the CCD that converts the optical image into image data. With this structure, the image reading apparatus 30 can scan the document from the lower part and from the upper part so as to read an image of the document, while the document is transported along the document transporting path by the automatic document feeder.

As described above, in the image reading apparatus 30, the operations of the automatic document feeder 36 are linked with the operations of the scanner unit 40 so that, while documents to be read are sequentially placed on the document plate 35, the scanner unit 40 moves along the lower face of the document plate 35 so as to read images of the documents.

The image reading apparatus 30 has an automatic reading mode and a manual reading mode. In the automatic reading mode, documents that are in a form of sheets are automatically fed by the automatic document feeder. Then, the documents are sequentially exposed and scanned, one by one, so that images of the documents are read. On the other hand, in the manual reading mode, a document such as a book or the like or a document in a sheet form that cannot be automatically fed by the automatic document feeder is manually placed on the document plate 35 and then an image of the document is read.

In the image forming apparatus 100, the partition 1 prevents airborne toner inside of the apparatus (inside of the partition 1) from adhering to the image reading apparatus 30. This prevents the airborne toner from adhering to the optical members (e.g., lens, mirror) of the image reading apparatus 30. Therefore, precision in image reading is prevented from deteriorating.

The recording medium feeder 70 is a recording medium accommodating tray that accommodates a sheet to be used as a recording medium by the image forming apparatus 100. As illustrated in FIG. 14, the recording medium feeder 70 includes (i) recording medium feeding sections 71 to 73 and (ii) a recording medium ejecting section 74. The respective recording medium ejecting sections may accommodate a variety of sheets that differ in, for example, size or material. Further, the recording medium feeder 70 serves as a desk on which the image forming apparatus 100 is to be provided. The recording medium feeder 70 is detachably provided to the image forming apparatus 100.

The recording medium feeding sections 71 to 73 store sheets (recording medium) to be fed to the image forming apparatus 100. In accordance with the controller 110 of the image forming apparatus 100, the recording medium feeder 70 selectively causes, for example, the pickup roller 75 of a selected one of the recording medium feeding sections 71 to 73 to operate, thereby feeding the sheets, one by one, to the recording medium ejecting section 74 from the recording medium feeding sections 71 to 73. After having been ejected from the recording medium ejecting section 74, the sheet is then sent to a sheet receiving opening 17.

As illustrated in FIG. 1, the lower face of the image forming apparatus 100 has the sheet receiving opening 17 that (i) receives a sheet fed by the recording medium feeder 70 and (ii) sequentially feeds the sheet to the space (transfer section)

between the photoreceptor drum 3 and the transfer device 6. This enables the image forming apparatus 100 to perform on the sheet from the recording medium feeder 70 the same processes as in forming an image on the sheet fed by the feeder tray 10.

In order to replenish the recording medium feeding sections 71 to 73 with sheets, the recording medium feeding sections 71 to 73 are pulled out from the front side of the main body of the recording medium feeder 70. In the same manner, in order to exchange the sheets stored in the recording medium feeding sections 71 to 73, the recording medium feeding sections 71 to 73 are pulled out from the front side of the main body of the recording medium feeder 70. In the image forming apparatus 100, the recording medium feeding sections 71 to 73 are provided outside of the partition 1. Therefore, the recording medium feeding sections are replenished with sheets, while the reduced pressure inside of the partition 1 is maintained.

Although the recording medium feeder 70 includes three recording medium feeding sections 71 to 73 in the present embodiment, the recording medium feeder 70 may also include (i) at least one recording medium feeding section or more than one recording medium feeding sections and (ii) a recording medium ejecting section.

The recording medium feeder 76, as illustrated in FIG. 14, includes a recording medium feeding section 77 and a recording medium ejecting section 78. The recording medium feeding section 77 is a recording medium storage tray where sheets are stored. The recording medium feeder 76 can store a vast number of sheets that is greater than the number of sheets the recording medium feeding sections 71 to 73 can store.

In accordance with an instruction of the controller 110 of the image forming apparatus 100, the recording medium feeder 76 causes a pickup roller 79 to operate, thereby feeding the sheets, one by one, from the recording medium feeding section 77 to the recording medium ejecting section 78 located on the upper right part of the recording medium feeder 76. After having been ejected from the recording medium ejecting section 78, the sheet is then sent to a recording medium receiving extended section 18 (an extended section for receiving the recording medium) at a lower part of the image forming apparatus 100.

As illustrated in FIG. 1, at a lower part of a side face of the image forming apparatus 100, there is provided the recording medium receiving extended section 18 that (i) receives a sheet sent from the recording medium feeder 76 and (ii) sequentially feeds the sheet to the space (transfer section) between the photoreceptor drum 3 and the transfer device 6. This enables the image forming apparatus 100 to perform on the sheet sent from the recording medium feeder 76 the same processes as in forming an image on the sheet sent from the feeder tray 10.

The recording medium re-feeding transport device (recording medium transporting path unit) 90 is used for recording images on both sides of a sheet. Specifically, the recording medium re-feeding transport device 90 (i) reverses the sheet, on one side of which an image is recorded, and then (ii) sends the sheet to the space (transfer section) between the photoreceptor drum 3 and the transfer device 6 in the image forming apparatus 100.

In double-sided image formation by the image forming apparatus 100, the fixing device 8 fixes a toner image onto one side of a sheet, and then the reverse rollers 26 transport the sheet toward the stack tray 15. In this case, however, the sheet would not be ejected completely. While holding the sheet, the reverse roller 26 rotate in the opposite direction. Then, the sheet is transported back in the opposite direction, that is, toward the recording medium re-feeding transport device 90.

At this time, the switch gate 9 is switched to the position indicated by the broken line in FIG. 1 from the position indicated by the continuous line in FIG. 1. As a result, the sheet transported back is sent back to the transfer section in the image forming apparatus 100 through the recording medium re-feeding transport device 90.

The relaying transport unit 91, as illustrated in FIG. 14, is provided between the recording medium re-feeding transport device 90 and the post-processing apparatus 93. A sheet that has an image and is ejected from the image forming apparatus 100 is transported to the post-processing apparatus 93 by the relaying transport unit 91. The relaying transport unit 91 is supported in such a way that the entire portion of the relaying transport unit 91 is rotatable about a rotation point 92, which connects the relaying transport unit 91 and the post-processing apparatus 93.

The post-processing apparatus 93 performs post-processes (e.g., stapling, punching) on the sheet on which an image is formed and which is ejected from the image forming apparatus 100.

As illustrated in FIG. 14, the post-processing apparatus 93 is provided with a receiving transporting section 94, a first recording-material ejecting section 95, and a second recording-material ejecting section 96. The receiving transporting section 94 receives a sheet having ejected from the image forming apparatus 100 through the relaying transport unit 91. Further, in accordance with an instruction of the controller 110, the post-processing apparatus 93 transports the sheet that has an image and is ejected from the image forming apparatus to (i) the first recording-material ejecting section 95 or (ii) the second recording-material ejecting section 96.

The first recording-material ejecting section 95 ejects, as the way it is, the sheet that the receiving transporting section 94 has received.

The second recording-material ejecting section 96 is a section for ejecting a sheet that has been received by the receiving transporting section 94 and then subjected to a post process such as stapling, punching or the like performed by a post-processing apparatus (not illustrated).

As the post-processing apparatus, for example the following post-processing apparatuses may be used: a post-processing apparatus that staples a desired number of sheets; a post-processing apparatus that folds the sheets; a post-processing apparatus that punches the sheets so as to make holes for filing; and a post-processing apparatus that performs sorting or assorting, the post-processing apparatus including several to several tens of recording medium ejecting sections. One or more of the post-processing apparatuses mentioned above may be selected and provided to the post-processing apparatus 93.

An image forming apparatus according to the present invention is an image forming apparatus comprising (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image (e) a transfer device for transferring the visualized image onto a recording medium, and (f) a fixing device for fixing, to the recording medium, the developer transferred to the recording medium. In order to attain the object, the image forming apparatus further comprises: a partitioning member for isolating a space from an outside space, the space encompassing at least: (i) a space encompassing (a) the developing device and (b) a part of the image holding member, which part faces the developing device; (ii) a space encompassing (a) the transfer device and (b) a part of the image holding member, which part faces the transfer device; and (iii) a space encompassing the fixing device; and a pressure reducing device for reducing a pressure of an isolated space below a pressure of the outside space.

In the above structure, the pressure of the isolated space is reduced so that a decrease in processing efficiency due to humidity change can be prevented.

For example, with the arrangement the space encompassing (a) the developing device and (b) a part of the image holding member, which part faces the developing device, is partitioned off (isolated) from the outside, are under reduced pressure space, the humidities in (a) the developing device and (b) the space between the image holding member and the developing device are prevented from increasing. This prevents the toner from absorbing the moisture, and therefore prevents a resistance of the toner from decreasing, thereby preventing a decrease in an amount of an electric charge the toner bears. Thus, the deterioration in the performance of development due to humidity change can be prevented.

Further, by reducing the pressure of the space, an air resistance can be reduced. This shortens a flight duration of the toner, and therefore airborne toner can be collected efficiently. Thus, even in the case where, for example, toner is downsized in order to improve image quality, the toner can be collected efficiently. Further, the airflow due to, for example, rotation of the image holding member or the rotating members (e.g., development roller, stirrer roller) of the developing device is restrained, and therefore scattering of the toner is also restrained. Thus, even in the case where, for example, rotation of the image holding member is speeded up in order to expedite the processing speed (to increase the number of sheets can be handled by the image formation per unit time), the airflow due to the rotation can be restrained, and therefore scattering of the toner can also be restrained. Further, by reducing the pressure inside of the partitioning member, the toner can be prevented from spouting out of the partitioning member.

Further, with this arrangement the space encompassing (a) the transfer device and (b) a part of the image holding member, which part faces the transfer device, is partitioned off from the outside, and are under reduced pressure, a resistance change due to humidity change is reduced, which humidity change occurs in, for example, the transfer device, the paper path (recording paper transporting path), the recording medium, or toner. This restrains a decrease in transfer efficiency.

Further, with the arrangement in which the space encompassing the fixing device is partitioned off from the outside, is under reduced pressure space, heat-conductivity change caused by humidity change is reduced, which humidity change occurs in the members of the fixing device, a recording medium, or toner. As a result, a decrease in fixing performance due to heat-conductivity change and in efficiency in utilizing heat energy is restrained. Further, by reducing the pressure of the space encompassing the fixing device, air convection in the vicinity of the fixing device is reduced. This restrains heat dispersion caused by the air convection, and therefore loss of heat energy is reduced.

The above image forming apparatus may be arranged such that the isolated space encompasses (i) the charging device and (ii) a part of the image holding member, which part faces the charging device.

With the above structure, by reducing the pressure in the charging device and the space between the image holding member and the charging device, the humidity in the space is restrained from changing. Therefore, a decrease in charging efficiency due to humidity can be avoided.

An image forming apparatus is an image forming apparatus comprising (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image (e) a transfer device for transferring the visualized image onto a recording medium, and (f) a fixing device for fixing, to the recording medium, the developer transferred to the recording medium. In order to attain the object, the image forming apparatus is arranged such that the charging device includes a discharge electrode that is provided so as not to contact with the image holding member, and a performing non-contact electrification by charging the image holding member by generating a corona discharge between the discharge electrode and the image holding member, and the image forming apparatus further comprises: a partitioning member for isolating (i) a space from an outside space, the space encompassing (a) the discharge electrode and (b) a part of the image holding member, which part faces the discharge electrode from (ii) the outside space; and a pressure reducing device for reducing a pressure of an isolated space below a pressure of the outside space.

The above structure prevents an increase in the humidity in the space between the discharge electrode and the image holding member, thereby avoiding a decrease in charging efficiency due to humidity. Further, by reducing the pressure of the space between the discharge electrode and the image holding member, (i) the discharge onset voltage can be reduced and (ii) charging efficiency can be improved. Further, by avoiding the decrease in the charging efficiency, it is possible to prevent an increase in the amount of ozone or nitride oxide generated.

Further, the partitioning member may be so arranged as to isolate a space from an outside space, the space encompassing the image holding member, the charging device, the developing device, the transfer device, and the fixing device.

With the above structure, it is possible to prevent a decrease in processing efficiency due to humidity change in charging, developing, transferring, or fixing. Further, with the above structure, the space containing developer that has not been fixed to a recording medium can be partitioned off from the outside space. This prevents airborne developer in the isolated space from scattered to the outside of the partitioning member. Therefore, the airborne developer is prevented from (i) spouting to the outside of the image forming apparatus and therefore (ii) adhering to the members provided outside of the partitioning member. Thus, the environment surrounding the image forming apparatus is prevented from getting dirty, and it is possible to avoid degrading the performance of the image forming apparatus due to the airborne toner.

Further, the partitioning member may be arranged to include: a partition that is provided to surround the isolated space; a set of transporting members at an aperture of the partition, the transporting members being for carrying a recording medium in or out of the isolated space by rotating in opposite directions to each other, while sandwiching the recording medium therebetween; and a sealing member in a gap between the partition and the transporting members, the sealing member preventing outside air from entering the isolated space.

With the above structure, the outside air is prevented from entering the partitioned space. This makes it possible to maintain the reduced pressure in the partitioned space.

Further, the sealing member may comprise: a magnetic field generating member for generating a magnetic field between the transporting members and the partition; and a magnetic fluid, retained in a gap between the transporting member and the partition by the magnetic field, for sealing the gap between the transporting member and the partition. The magnetic fluid is a composite containing ferromagnetic ultrafine particles evenly dispersed in a liquid. Neither agglomeration of particles nor separation between solid and liquid occurs even under a strong magnetic field, and the magnetic fluid acts as if the magnetic fluid is ferromagnetic as a whole.

With the above structure, even when the rotation roller rotates, the outside air is prevented from entering the partitioned space.

Further, the image forming apparatus may further comprise a recording medium storing section, outside of the isolated space, for storing the recording medium, on which an image is to be formed.

In the above structure, the recording medium storing section is provided outside of the isolated space. Therefore, replenishment or exchange of the recording mediums can be operated while the reduced pressure of the isolated space is maintained. This prevents efficiency of the operation from decreasing.

Further, the image forming apparatus may further comprise a heat radiating member, on an exterior surface of the partitioning member, for facilitating releasing heat from the isolated space to the outside.

With the above structure, by facilitating releasing heat from the isolated space to the outside, the temperature in the space is prevented from increasing.

Further, the image forming apparatus may be arranged such that the fixing device is (i) provided inside of the isolated space and (ii) positioned to face the partitioning member; and the heat radiating member is (i) located on that position on the exterior surface of the partitioning member which faces the fixing device.

The above structure facilitates heat release from the fixing device to the outside of the partitioning member. Therefore, the fixing device is prevented from being heated extraordinarily by accumulated heat.

Further, the image forming apparatus may further comprise a heat insulator for restraining dispersion of heat from an inside of the fixing device to the isolated space, the fixing device being provided inside of the isolated space.

With the above structure, the heat in the fixing device is restrained from dispersing within the isolated space. Therefore, the temperature in the space can be restrained from increasing. Further, it is possible to prevent negative effects caused by heat to be used in the fixing process for example, when the heat reaches the driving system of the fixing device.

Further, the image forming apparatus may be arranged such that the fixing device is provided inside of the isolated space and (ii) comprises a heating member, the image forming apparatus comprising: a heat recycling mechanism that (i) collects heat having dispersed from the fixing device to the isolated space and (ii) supplies the collected heat to the heating member.

With the above structure, energy used for heating in the fixing device can be cut down, and therefore power consumption can be reduced.

Further, the image forming apparatus may be arranged such that the charging device comprises: a suction device for sucking air between the charging device and the image holding member, and for passing the air through the charging device; and an ozone removing member for removing or decomposing ozone contained in the air having been sucked and having been passed through the charging device.

With the above structure, ozone generated in the charging device is prevented from (i) reaching a surface of the image holding member and (ii) generating nitride oxide on the surface. This reduces uniformity in charges on the surface of the image holding member, and prevents an image density of the image developed on the image holding member from becoming unstable. Further, the ozone is prevented from spouting to the outside of the partitioning member.

Further, the developing device may comprise a suction device for sucking air between the developing device and the image holding member so as to let the air be sucked into the developing device; and a developer removing member for removing developer contained in the air having been sucked into the developing device.

In the above structure, the suction device sucks the air between the developing device and the image holding member so as to let the air be sucked into the developing device. This prevents the developer in the developing device from being scattered out of the developing device. Further, the developer contained in the air sucked by the suction device can be removed by the developer removing member.

Further, the latent image forming device may be provided outside of the isolated space, the latent image forming device exposing the image holding member to form an electrostatic latent image.

With the above structure, the airborne developer in the isolated space is prevented from adhering to the optical members of the latent image forming device. This prevents the developer from (i) adhering to the optical members of the latent image forming device and (ii) making the optical system of the latent image forming device dirty. Therefore, it is possible to prevent deteriorating precision in image forming.

Further, the image forming apparatus may further comprise an image reading apparatus, provided outside of the isolated space, for reading an image of a document.

With the above structure, the airborne developer in the isolated space is prevented from being scattered the image reading apparatus. This prevents the toner from, for example, adhering to the optical members of the image reading apparatus, and therefore prevents deterioration in precision in image reading.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image, (e) a transfer device for transferring the visualized image onto a recording medium, and (f) a fixing device for fixing, to the recording medium, the developer transferred to the recording medium, the image forming apparatus further comprising:

a partitioning member for isolating a space from an outside space and for preventing outside air from flowing into the space, the space encompassing at least:

(i) a space encompassing (a) the developing device and (b) a part of the image holding member, which part faces the developing device;

(ii) a space encompassing (a) the transfer device and (b) a part of the image holding member, which part faces the transfer device; and (iii) a space encompassing the fixing device; and a pressure reducing device for reducing a pressure of the isolated space below a pressure of the outside space, wherein the partitioning member comprises:

a partition that is provided to surround the isolated space;

a set of transporting members at an aperture of the partition, the transporting members being for carrying a recording medium in or out of the isolated space by rotating in opposite directions to each other, while sandwiching the recording medium therebetween; and a sealing member in a gap between the partition and the transporting members, the sealing member preventing outside air from entering the isolated space.

2. The image forming apparatus as set forth in claim 1, wherein the isolated space encompasses (i) the charging device and (ii) a part of the image holding member, which part faces the charging device.

3. The image forming apparatus as set forth in claim 1, wherein the partitioning member isolates a space from an outside space, the space encompassing the image holding member, the charging device, the developing device, the transfer device, and the fixing device.

4. The image forming apparatus as set forth in claim 1, wherein the sealing member comprises: a magnetic field generating member for generating a magnetic field between the transporting members and the partition; and a magnetic fluid, retained in a gap between the transporting member and the partition by the magnetic field, for sealing the gap between the transporting member and the partition.

5. The image forming apparatus as set forth in claim 1, further comprising:

a recording medium storing section, outside of the isolated space, for storing the recording medium, on which an image is to be formed.

6. The image forming apparatus as set forth in claim 1, further comprising:

a heat radiating member, on an exterior surface of the partitioning member, for facilitating releasing heat from the isolated space to the outside.

7. The image forming apparatus as set forth in claim 6, wherein:

the fixing device is (i) provided inside of the isolated space and (ii) positioned to face the partitioning member; and the heat radiating member is located on that position on the exterior surface of the partitioning member which faces the fixing device.

8. The image forming apparatus as set forth in claim 1, further comprising:

a heat insulator for restraining dispersion of heat from an inside of the fixing device to the isolated space, the fixing device being provided inside of the isolated space.

9. The image forming apparatus as set forth in claim 1, wherein the fixing device is provided inside of the isolated space and comprises a heating member, the image forming apparatus comprising:

a heat recycling mechanism that (i) collects heat having dispersed from the fixing device to the isolated space and (ii) supplies the collected heat to the heating member.

10. The image forming apparatus as set forth in claim 1, wherein the charging device comprises:

a suction device for sucking air between the charging device and the image holding member, and for passing the air through the charging device; and an ozone removing member for removing or decomposing ozone contained in the air having been sucked and having been passed through the charging device.

11. The image forming apparatus as set forth in claim 1, wherein the developing device comprises:

a suction device for sucking air between the developing device and the image holding member so as to let the air be sucked into the developing device; and a developer removing member for removing developer contained in the air having been sucked into the developing device.

12. The image forming apparatus as set forth in claim 1, wherein the latent image forming device is provided outside of the isolated space, the latent image forming device exposing the image holding member to form an electrostatic latent image.

13. The image forming apparatus as set forth in claim 1, further comprising:

an image reading apparatus, provided outside of the isolated space, for reading an image of a document.

14. An image forming apparatus, comprising (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image, (e) a transfer device for transferring the visualized image onto a recording medium, and (f) a fixing device for fixing, to the recording medium, the developer transferred to the recording medium, the charging device comprising a discharge electrode that is provided so as not to contact with the image holding member, and performing non-contact electrification by charging the image holding member by generating a corona discharge between the discharge electrode and the image holding member, and the image forming apparatus further comprising:

a partitioning member for isolating (i) a space from an outside space and for preventing outside air from flowing into the space, the space encompassing (a) the discharge electrode and (b) a part of the image holding member, which part faces the discharge electrode from (ii) the outside space; and a pressure reducing device for reducing a pressure of the isolated space below a pressure of the outside space, wherein the partitioning member comprises:

a partition that is provided to surround the isolated space;

a set of transporting members at an aperture of the partition, the transporting members being for carrying a recording medium in or out of the isolated space by rotating in opposite directions to each other, while sandwiching the recording medium therebetween; and a sealing member in a gap between the partition and the transporting members, the sealing member preventing outside air from entering the isolated space.

15. The image forming apparatus as set forth in claim 14, wherein the partitioning member isolates a space from an outside space, the space encompassing the image holding member, the charging device, the developing device, the transfer device, and the fixing device.

16. The image forming apparatus as set forth in claim 14, wherein the sealing member comprises: a magnetic field generating member for generating a magnetic field between the transporting members and the partition; and a magnetic fluid, retained in a gap between the transporting member and the partition by the magnetic field, for sealing the gap between the transporting member and the partition.

17. The image forming apparatus as set forth in claim 14, further comprising:

a recording medium storing section, outside of the isolated space, for storing the recording medium, on which an image is to be formed.

18. The image forming apparatus as set forth in claim 14, further comprising:

a heat radiating member, on an exterior surface of the partitioning member, for facilitating releasing heat from the isolated space to the outside.

19. The image forming apparatus as set forth in claim 14, further comprising:

a heat insulator for restraining dispersion of heat from an inside of the fixing device to the isolated space, the fixing device being provided inside of the isolated space.

20. The image forming apparatus as set forth in claim 14, further comprising:

the fixing device is provided inside of the isolated space and comprises a heating member, the image forming apparatus comprising:

a heat recycling mechanism that (i) collects heat having dispersed from the fixing device to the isolated space and (ii) supplies the collected heat to the heating member.

21. The image forming apparatus as set forth in claim 14, wherein the charging device comprises:

a suction device for sucking air between the charging device and the image holding member, and for passing the air through the charging device; and an ozone removing member for removing or decomposing ozone contained in the air having been sucked and having been passed through the charging device.

22. The image forming apparatus as set forth in claim 14, wherein the developing device comprises:

a suction device for sucking air between the developing device and the image holding member so as to let the air be sucked into the developing device; and a developer removing member for removing developer contained in the air having been sucked into the developing device.

23. The image forming apparatus as set forth in claim 14, wherein the latent image forming device, provided outside of the isolated space, for exposing the image holding member to form an electrostatic latent image.

24. The image forming apparatus as set forth in claim 14, further comprising:

an image reading apparatus, provided outside of the isolated space, for reading an image of a document.

25. An image forming apparatus, comprising (a) an image holding member, (b) a charging device for charging the image holding member, (c) a latent image forming device for forming an electrostatic latent image on the image holding member, (d) a developing device for visualizing, with developer, the electrostatic latent image formed on the image holding member, so as to form a visualized image, (e) a transfer device for transferring the visualized image onto a recording medium, and (f) a fixing device for fixing, to the recording medium, the developer transferred to the recording medium, the charging device comprising a discharge electrode that is provided so as not to contact with the image holding member, and performing non-contact electrification by charging the image holding member by generating a corona discharge between the discharge electrode and the image holding member, and the image forming apparatus further comprising:

a partitioning member for isolating (i) a space from an outside space and for preventing outside air from flowing into the space, the space encompassing (a) the discharge electrode and (b) a part of the image holding member, which part faces the discharge electrode from (ii) the outside space;

a pressure reducing device for reducing a pressure of the isolated space below a pressure of the outside space; and a heat radiating member, on an exterior surface of the partitioning member, for facilitating releasing heat from the isolated space to the outside, wherein:

the fixing device is (i) provided inside of the isolated space and (ii) positioned to face the partitioning member; and the heat radiating member is located on that position on the exterior surface of the partitioning member which faces the fixing device.

* * * * *